United States Patent [19]

Iwaki et al.

[11] Patent Number: 4,764,789

[45] Date of Patent: Aug. 16, 1988

[54] APPARATUS FOR INPUTTING IMAGE FORMING CONDITION

[75] Inventors: Hiroshi Iwaki; Kiyoshi Sakamoto; Akira Inada; Shinichi Kikkawa, all of Hyogo, Japan

[73] Assignee: Sanyo Electric Co., Ltd., Japan

[21] Appl. No.: 73,817

[22] Filed: Jul. 15, 1987

[30] Foreign Application Priority Data

Jul. 28, 1986 [JP] Japan ..... 61-178437
Aug. 20, 1986 [JP] Japan ..... 61-194728

[51] Int. Cl.[4] ..... G03G 15/00

[52] U.S. Cl. ..... 355/14 R; 355/3 R; 340/709; 340/713; 340/718

[58] Field of Search ..... 355/3 R, 14 R, 14 CU; 340/709, 713, 718, 792, 715

[56] References Cited

U.S. PATENT DOCUMENTS 4,603,962 8/1986 Dekura ..... 355/3 R
4,609,919 9/1986 Miyazaki et al. ..... 340/792
4,614,421 9/1986 Nishiyama ..... 355/14 CU
4,619,521 10/1986 Miyamoto ..... 355/14 R
4,699,501 10/1987 Watanabe et al. ..... 355/14 R

*Primary Examiner*—A. C. Prescott
*Attorney, Agent, or Firm*—Darby & Darby

[57] ABSTRACT

An apparatus for inputting image forming condition includes a display having item displaying portion in which a plurality of items of image forming condition for controlling image forming process are respectively displayed for each item and cursor displaying portion in which a plurality of cursors are formed so as to correspond to the respective items. A desired one of a plurality of cursors included in the cursor displaying portion is selectively displayed by a cursor key. When a given item is designated by the cursor key and a change key is operated in that state, content of that item is changed for every operations of the change key. The content lastly changed is inputted as image forming condition of that item.

24 Claims, 33 Drawing Sheets

FIG. 28

360

LTR→LG 127% S=010 N=4 ma=0 ed=1 2pg=N

| 364 | 366 | 368 | 370 | 372 | 374 | 376 | 378 |
|---|---|---|---|---|---|---|---|
| ORIGINAL SIZE | PAPER SIZE | COPY MAGNIFI-CATION | COPY QUANTITY | COPY DENSITY | SIFT MARGIN | EDGING /BOOK | 2-PAGE COPY |
| LD | LD | | 991 | 7 | 0 | 0 | N |
| 10x14 | 10x14 | 141% | | | 1 | 1 | ↕ |
| LG | LG | | \| | \| | 2 | 2 | |
| LTR | LTR | \| | | | 3 | 3 | Y |
| STR | STR | 64% | 1 | 1 | | | |
| | LT | | | | | | |
| | ST | | | | | | |

APPARATUS FOR INPUTTING IMAGE FORMING CONDITION

BACKGROUND OF THE INVENTION

1. The Field of the Invention

The present invention relates to an apparatus for inputting image forming condition. More specifically, the present invention relates to an apparatus for inputting image forming condition, in which a large number of items of image forming condition can be inputted and set by utilizing a small number of keys.

2. Description of the Prior Art

A copying machine capable of decreasing the number of keys provided in an operating portion without decreasing functions is disclosed in, for example, Japanese Patent Laying-Open No. 460/1985. In this copying machine, there are provided in an operating portion a liquid crystal display, a plurality of function keys for selecting contents to be displayed on the liquid crystal display, and a plurality of preset keys for inputting contents of the mode selected by the function keys.

In the above described prior art, it is possible to decrease the number of keys in comparison with a former input device in which respective keys correspond to respective functions, but it is impossible to simultaneously display all of the inputted information on the liquid crystal display. More specifically, if all of the inputted information should be confirmed on the liquid crystal display, a portion of the inputted information is first confirmed after operating a corresponding function key and it is necessary to repeat that further function keys are operated to confirm the other inputted information. Therefore, an operability in inputting the information is bad and operation for confirming the inputted information is troublesome.

SUMMARY OF THE INVENTION

Therefore, it is a principal object of the present invention is to provide a novel apparatus for inputting image forming condition.

Another object of the present invention is to provide an apparatus for inputting image forming condition having simple operation.

Still another object of the present invention is to provide an apparatus for inputting image forming condition, in which it is possible to set a large number of items by a small number of keys and respective items of image forming condition as inputted can be visibly confirmed simultaneously.

The other object of the present invention is to provide an apparatus for inputting image forming condition capable of decreasing error in inputting image forming condition.

In brief, the present invention is an apparatus for inputting image forming condition, comprising a display having an item displaying portion in which a plurality of items of image forming condition for controlling image forming process are respective displayed for each item and a cursor displaying portion in which a plurality of cursors are formed so as to correspond to the respective item, cursor selecting means for selecting a desire one of the plurality of cursors included in the cursor displaying portion, operating means which is operated to change image forming condition, and display changing means for changing the content displayed on the item displaying portion corresponding to the cursor which is selectively displayed at a time when the operating means is operated, wherein the content lastly changed is inputted as image forming condition of that item.

Such an apparatus for inputting image forming condition can be provided on an operating panel of an image forming apparatus such as a copying machine, but the same may be applied to an input device, for example, an editor board separated from the image forming apparatus.

When item such as a copy magnification or a copy quantity out of image forming condition should be inputted, first, cursor selecting means is operated. Then, the cursor corresponding to a portion of item showing a copy magnification, for example, is selectively displayed. Thereafter, when the operating means is operated, the content of the copy magnification displayed on the item displaying portion is changed by the displaying changing means in response to an operation of the operating means. When the item of the copy quantity, for example, is to be inputted, the cursor which is presently displayed at the position corresponding to the item of the copy magnification is moved to the portion corresponding to the copy quantity by cursor selecting means. Thereafter, if the operating means is further operated as similar to the above, the content of the copy quantity displayed on the item displaying portion is changed by displaying changing means in response to an operation of the operating means.

If and when the image forming condition which has been inputted should be changed, the cursor of the cursor displaying portion is moved to the item of the item displaying portion corresponding thereto by the cursor selecting means, and thereafter the operating means is operated.

In accordance with the present invention, all items of the image forming condition can be respectively displayed on the item displaying portion and therefore it is possible to visibly and simultaneously confirm the inputted image forming condition. Accordingly, it is possible to decrease an error as inputted in comparison with a conventional input device in which it is impossible to simultaneously display all of the inputted information.

Furthermore, the respective items can be simply inputted and changed by the cursor selecting means and the operating means and therefore, operability becomes very excellent. Also, a plurality of valiant functions can be inputted in accordance with a combination of the cursor selecting means and the operating means, and thus, it is possible to drastically decrease the number of keys necessary to input image forming condition.

The above described objects and other objects, features, aspects and advantages of the present invention will become more apparent from the following detailed description of the present invention when taken in conjunction with the accompanying drawings.

BRIEF DESCRIPTION OF THE DRAWINGS

FIG. 28 is an illustrative view showing a left panel, i.e. liquid crystal display of the operating panel of the embodiment.

DESCRIPTION OF THE PREFERRED EMBODIMENTS

Figure 1:
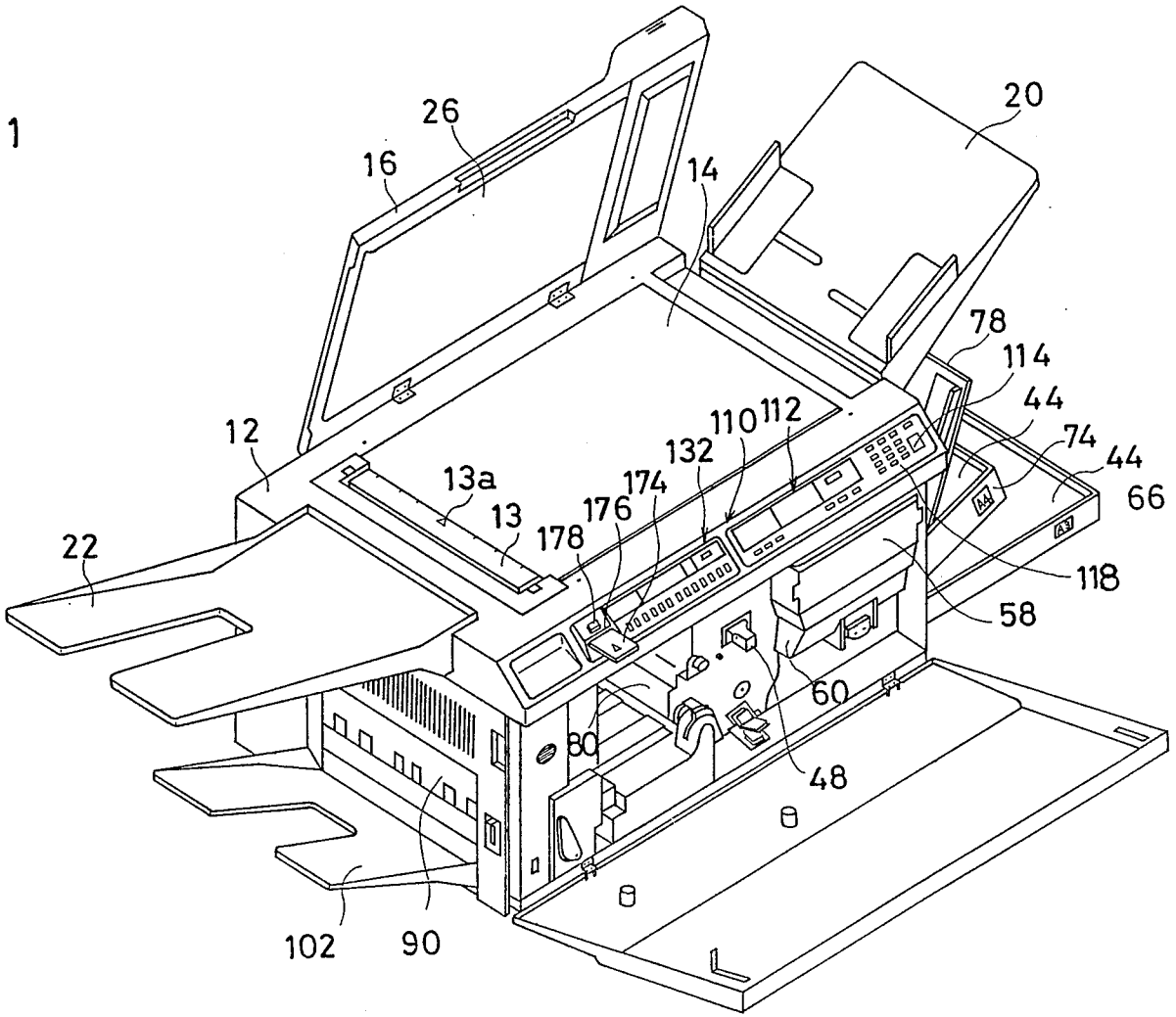
FIG. 1 is an appearance view showing one example of an electrophotographic copying machine included in one embodiment in accordance with the present invention.
Figure 2:
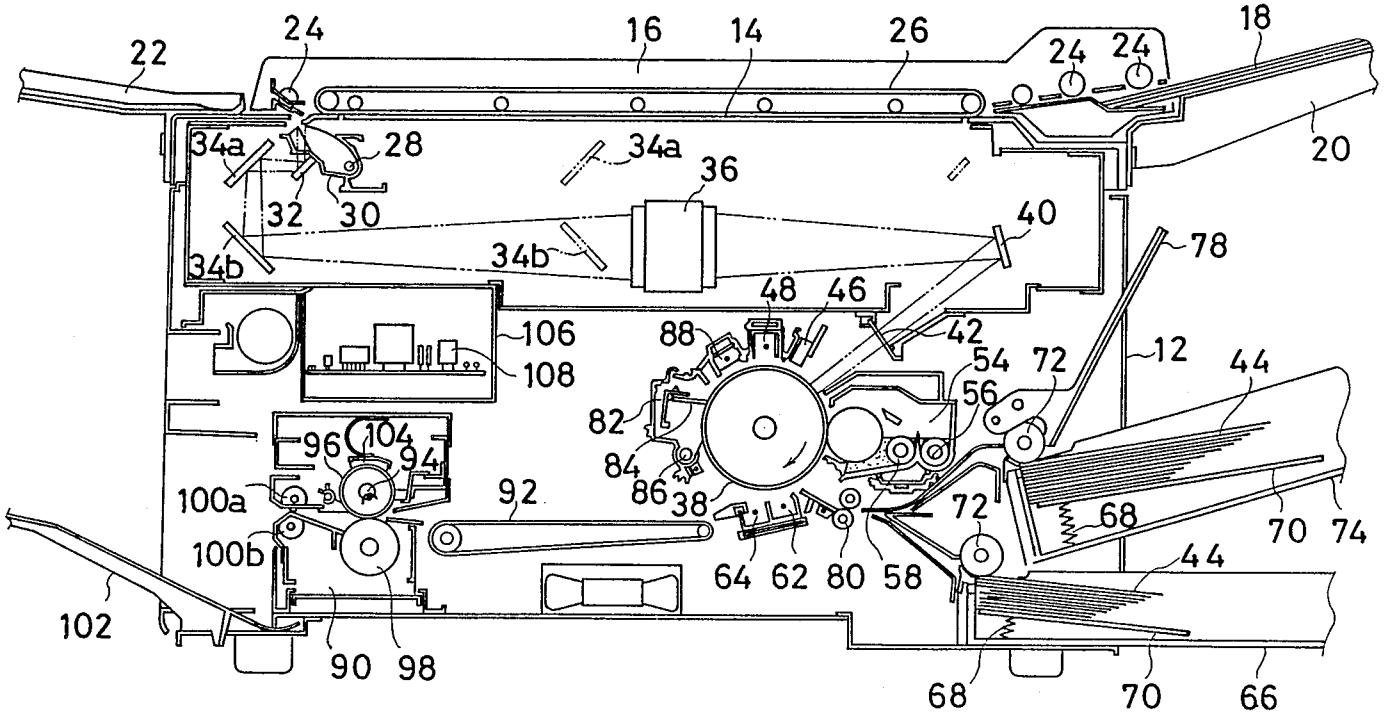
FIG. 2 is an illustrative cross-sectional view showing an inner structure of FIG. 1 embodiment.

FIG. 1 and FIG. 2 are structural views showing a copying machine included in one embodiment in accordance with the present invention, FIG. 1 is a perspective view thereof and FIG. 2 is a inner structural view thereof. An electrophotographic copying machine 10 includes a main unit 12. An original table 14 comprised of a transparent glass plate is fixedly provided on the top of the main unit 12. Above the original table 14, an automatic document feeder 16 is mounted by a hinge at the side end thereof. The automatic document feeder 16 includes a plurality of rollers 24 and an endless belt 26 so that an original 18 put on an original feeding table 20 can be transferred. The original which has been copied through the automatic document feeder 16 is transferred to an original receiving table 22.

Below the original table 14, a light source 28 as an optically scanning means for exposing and scanning the original 18 is installed in the main unit 12. The light source 28 is made movable from one end of the original table 14 to the other end thereof and vice versa. A movement of the light source 28 towards left and right is performed by a driving force of a servo motor (not illustrated). Associated with the light source 28, a reflecting mirror 30 having an elliptic cross-section is installed. A first movable mirror 32 is fixed to the reflecting mirror 30. When the light source 28 is moved toward right in FIG. 2 by the servo motor, the original 18 put on the original table 14 is subjected to a slit-exposure. However, when the light source 28 is moved toward left in FIG. 2 no exposure is made.

In association with the first movable mirror 32, a pair of second movable mirrors 34*a* and 34*b* are provided. The pair of second movable mirrors 34*a* and 34*b* are for reflecting again the original image reflected by the first movable mirror 32 toward a focusing lens 36. The second movable mirrors 34*a* and 34*b* are moved in the same direction as the light source 28 at a half speed thereof. In addition, the focusing lens 36 is, in the embodiment shown, constructed by a zoom lens, and therefore a copy magnification can be changed.

In front of the zoom lens 36, a fixed reflecting mirror 40 is installed so as to reflect the original image through the lens 36 toward a photosensitive drum 38. An infrared light absorbing filter 42 is interposed between the fixed reflecting mirror 40 and the photosensitive drum 38.

At the downstream side from an exposed position of the photosensitive drum 38, that is, the position where the original image is focused by the fixed reflecting mirror 40, a partial erasure lamp, that is, an LED array 46 is installed which partly erases a useless electrostatic latent image. At the upstream side from the partial erasure lamp 46, a charging corotron 48 for uniformly charging the photosensitive drum 38 in a predetermined polarity is installed.

At the downstream side from the exposed position of the photosensitive drum 38, a developing device 54 is installed, which develops the electrostatic latent image formed on the photosensitive drum 38 by the charging corotron 46, the light source 28 and the zoom lens 36 by using a toner. Associated with the developing device 54, there are provided an agitator roller 56 for agitating a toner and a supplying roller 58 for supplying the charged toner to the photosensitive drum 38.

At one side of the main unit 12, a paper supplying part is formed. In the paper supplying part as shown, two paper feed cassettes 66 and 74 are attachably/detachably attached. Copy papers 44 having a different size are respectively accommodated in a stack fashion in the paper feed cassettes 66 and 74. At the bottom part of the paper feed cassettes 66 and 74, coil springs 68 for pushing up the stacked paper 44 and supporting plates 70, respectively. The copy papers 44 accommodated in the paper feed cassettes 66 and 74 are pushed up by the coil springs 68 and the supporting plates 70, the upper most copy paper 44 is brought in contact with paper feed rollers 72 to be picked up. One of the paper feed rollers 72 sends the copy paper 44 being pressure-contacted from the paper feed cassette 66 or 74 to a register roller 80 one by one in rotation thereof. In addition, a manually feeding plate 78 is provided in association with the upper one of the paper feed rollers.

At the downstream side from the developing device 54, a transferring corotron 62 and a separating corotron 64 are installed in a one-piece fashion.

When a copy paper 44 is fed from the paper feed cassette 66 or 74 a toner image formed on the photosensitive drum 38 is transferred onto the copy paper 44 by the transferring corotron 62. In transferring by the transferring corotron 62, the paper 44 is absorbed by the photosensitive drum 38 and intends to move together with the same, but the paper 44 is separated by the separating corotron 64, being fed toward a vacuum conveyer 92.

A cleaning device 82 is installed at the downstream side from the separating corotron 66 and in the vicinity of the peripheral side surface of the photosensitive drum 38. The cleaning device 82 removes a toner left on the photosensitive drum 38 after transferring onto the copy paper 44. The cleaning device 82 includes a rubber blade 84 for scraping off the remaining toner from the photosensitive drum 38. The the toner scraped off by the blade 84 is conveyed to a waste toner container by a screw conveyer 86.

At the further downstream side from the cleaning device 82, an erasure lamp 88 for removing a charge remaining on the photosensitive drum 38 is installed. At the downstream side from the erasure lamp 88, there is arranged the above-described charging corotron 46.

The copy paper 44 separated by the separating corotron 64 is sent to a fixing device 90 by the vacuum conveyer 92. The fixing device 90 is constituted with a heating roller 96 incorporating a heater 94 and a pressing roller 98 in pressure contact with the heating roller 96. The copy paper 44 on which the toner image is transferred is inserted between the heating roller 96 and the pressing roller 98, and thereby the same is heated and pressed to fix the toner image. The copy paper 44 after fixing is discharged onto a copy receiving tray 102 by discharging rollers **100*a* and 100*b***.

Furthermore, a control box 106 is formed above the fixing device 90 in the main unit 12. In the control box, there are accommodated circuit parts 108 as shown in FIG. 17 later.

An operating panel 110 is provided on an upper surface of this side of the main unit of the electrophotographic copying machine. In reference to FIG. 1 and FIG. 3, a start key 114 for commanding to start of a copying process is provided at the right end of a right panel 112 of the operating panel 110. Above the start key 114, a reset key 116 for releasing a mode set by an operation of keys in the operating panel 110 is provided. At the left side of the start key 114, a ten-key 118 for setting a copy quantity or for releasing such a setting and for processing an insertion copy is provided. A copy quantity set by the ten-key 118 is displayed on a numeral display 120 provided at the left side thereof. The numeral display 120 is a display of 3-digit display comprised of 7-segment.

A density indicator 122 for indicating a density of a copy image is provided below the numeral display 120. Under the density indicator 122, keys **124*a*–124*c* for setting a density of a copy image are provided. In automatically setting a copy density, the key 124*a* is operated. Then, "AUTO" of the density indicator 122 is lightened. In manually setting a copy density, the keys 124*c* and 124*b* are operated. A set density is indicated on the density indicator 122** in seven notches.

At the left side of the numeral display 120 and the density indicator 122, a status display 126 is provided, which is for displaying occurrences of a jam, a lack of toner, a lack of paper or the like. At the left side of the status display 126, that is, at the left end of the right panel 112, a size indicator 128 for indicating sizes of an original and a paper is provided. Below the size indicator 128, there is provided keys **130*a*–130*c* for setting sizes of the original and the paper. In addition, the decision which of two paper feed cassettes 66 and 74 attached as shown in FIG. 1 should be used is made by operating a paper size setting key 130*c*. When a paper size is set by the paper size setting key 130*c*, only one out of seven LEDs arranged at the right side in the size indicator 128 respectively corresponding to the respective paper size. When an original size is set by an original size setting key 130*a*, only one out of five LEDs arranged at the left side of the size indicator 128. If the original size and the paper size are thus set by the original size setting key 130*a* and the paper size setting key 130*c*, a magnification of an enlargement or a reduction of a copy is automatically decided. The decided magnification is displayed on a display described later. An equal magnification key 130*b*** is a key which is operated when an equal magnification copy should be made irrespective of the original size and the paper size.

At the right lower portion of a left panel 132, there are provided magnification setting keys **134*a* and 134*b* for setting a copy magnification of an enlargement or a reduction. The magnification set by these magnification setting keys 134*a* and 134*b* is displayed on a numeral display 136 provided thereabove. In addition, the magnification setting keys 134*a* and 134*b* are effectively operated only when the original size setting key 130*a* and the equal magnification key 130*b* were not operated. More specifically, when the copy magnification is set by operating the original size setting key 130*a* and the paper size setting key 130*c* the copy magnification automatically decided and being displayed on the numeral display 136**.

At the left side of the magnification setting key **134*b*, there is provided a 2-page copy key 138. When a left side and a right side of a opened book should be separately copied onto two sheets of papers, for example, the 2-page copy key 138 is used. When the 2-page copy key 138 is operated an LED 140** provided just above is lightened.

At the left side of the 2-page copy key 138, there is provided a margin shift key 142 for shifting and original image rightward and for copying so as to form a space for binding at the left side end of the paper. A margin setting key 144 for setting a margin width is provided at the left side of the margin shift key 142. When the margin shift key 142 is operated an LED 146 is lightened and the margin setting key 144 is becomes in the state that the same can be effectively operated. A margin width capable of being set by the margin setting key 144 is in three notches and, the set margin width is indicated by lightening any one of three LEDs 148.

At the left side of the margin setting key 144, there are provided a edging width setting key 150 and edging- /book selecting key 152. When an edging mode is set by the edging/book selecting key 152 an LED 154 is lightened, and when a book mode is set an LED 156 is lightened. The edging width setting key 150 can be effectively operated only when the edging mode is selected by the edging/book selecting key 152. The edging width setting key 150 is a key for preventing a line of the edge of the original from being copied, and an edging width is selected by the key 150 in three notches. The edging width as set is indicated by lightening only one of three LEDs 158.

At the left side of the edging/book selecting key 152, there is provided a trimming/masking selecting key 160 for selecting "trimming" or "masking" in an editing mode. When "trimming" is selected an LED 162 is lightened, and when "masking" is selected an LED 164 is lightened.

At the left side of the trimming/masking selecting key 160, there are provided a position setting key 160 for setting an area for "trimming" or "masking" and a memory key 168 for storing the area as set. In addition, in making "trimming" or "masking", a shape of area to be set is a rectangle and such an area can be designated by setting coordinates ($X_1$, $Y_1$) of a left lower corner of the rectangle and coordinates ($X_2$, $Y_2$) of a right upper corner. Coordinates of this two points are inputted by the ten-key 118. More specifically, when the position setting key 166 is operated a mode in which the ten-key 118 is enabled is set, upon completion of inputting the coordinates ($X_1$, $Y_1$) and ($X_2$, $Y_2$) of the two points by the ten-key 118, all of LEDs 170 provided thereabove are lightened. In this state, when the memory key 168 is operated the set area for "trimming" or "masking" is stored and only one LED besides "$M_1$" out of three LEDs 172. Then, the four LEDs 170 are put out and a state where inputting coordinates of the next area is enabled is set. In addition, the number of the areas capable of being stored by this console panel is three and, when all of three areas have been stored all of three LEDs 172 are lightened.

At the left side end of the left panel 132, there is formed a card insertion portion 176 having a slit-like card insertion opening and for attachably/detachably loading an IC card 174 as one example of a storage medium thereto. At the top of the card insertion portion 176, there is provided a loading key 178 for loading a copy condition information which is stored in the IC card 174 and includes a control condition and a editing condition.

Figure 4:
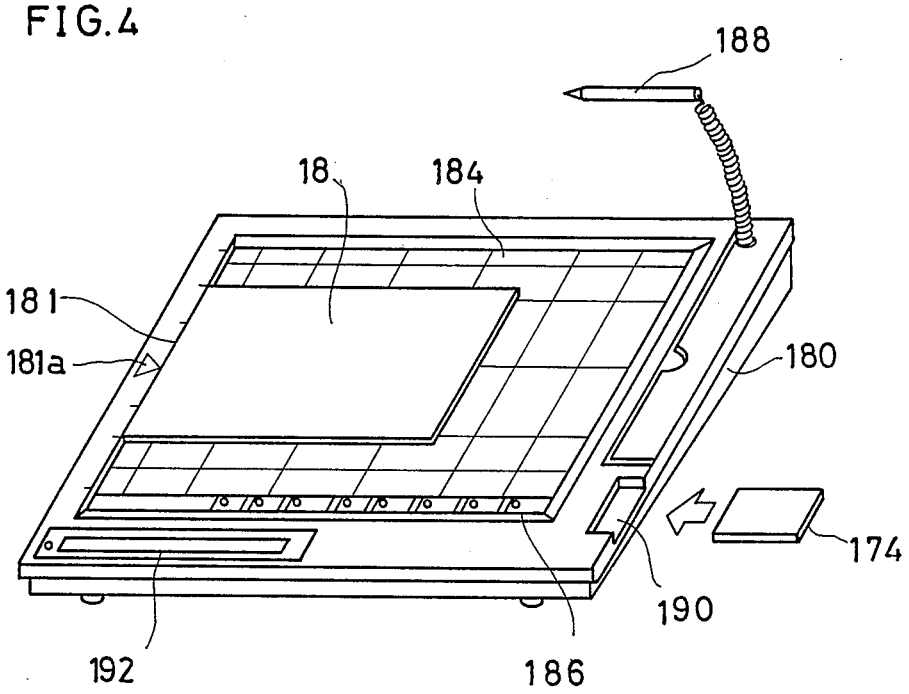
FIG. 4 is a perspective view showing one example of an editor which can be used in the embodiment.

FIG. 4 is a perspective view showing an editor which can be used in the embodiment of the present invention. On an editor board 180, there is provided a tablet 184 on which the original 18 is put and for inputting a copy condition information. A group of operating keys 186 for selecting an editing function such as "trimming", "masking" or the like or for setting a copy quantity and etc. are provided on the tablet 184. The editor board 180 is provided with an input pen 188 for designating a position on the original surface to be edited and the group of operating keys, which is connected to the editor board 180 by a curled cord. In addition, a left side of a original putting portion of the editor board 180 functions as a reference member or portion 181 on which a center mark 181*a* is formed.

On the right side surface of this side of the editor board 180, there is formed a card insertion portion 190 for attaching/detaching the afore-mentioned IC card 174. At the left hand of this side of the editor board 180, a liquid crystal display (LCD) 192 having a displaying area of 40 characters by two rows, for example is provided, and the inputted copy condition information and/or an operating message are displayed on the LCD 192.

Figure 5:
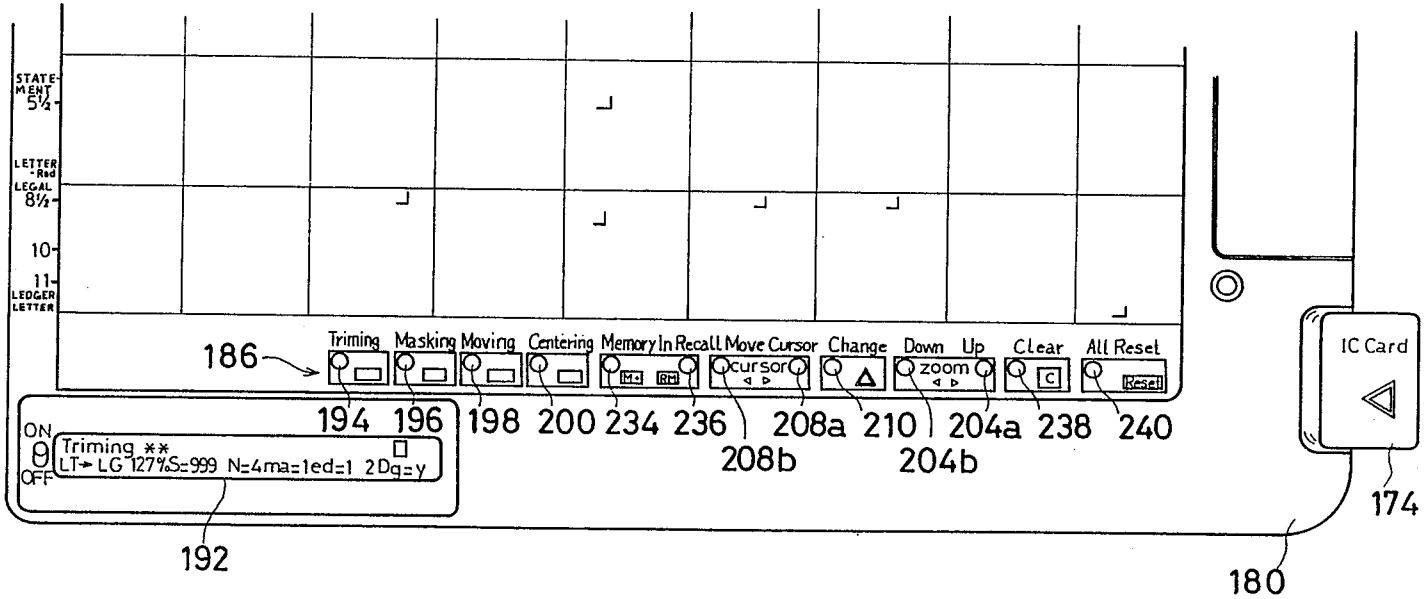
FIG. 5 is an illustrative view showing a major portion of FIG. 4 embodiment, especially a group of keys.

The group of operating keys 186 include, as shown an enlarged view of FIG. 5, keys capable of designating a copy quantity and a copy magnification and further a size of a paper on which a copying image is formed, other than keys for designating an editing function such as "trimming", "masking" or the like. The group of operating keys 186 can be operated by the input pen 188 and, an operated state is displayed on the LCD 192 as shown in an enlarged view of FIG. 6.

Functions for editing the original 18 put on the tablet 184, that is, "trimming", "masking", "moving" or "centering" can be set by operating any of keys 194–200 by the input pen 188. The set editing function is displayed on a function displaying portion 202 formed upper left in FIG. 6 as "Trimming", for example.

Figure 6:
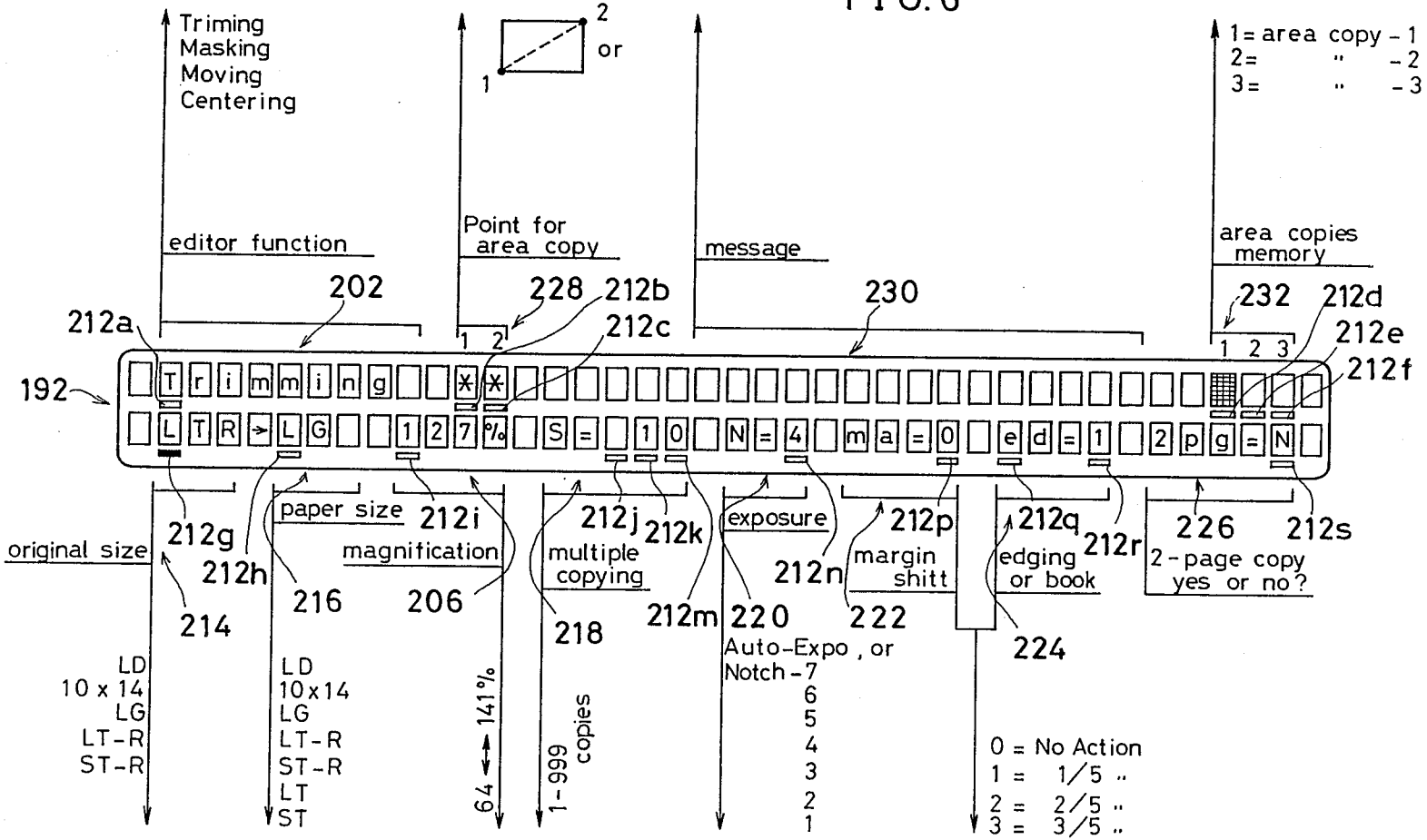
FIG. 6 is an illustrative view showing one example of a liquid crystal display of FIG. 4 embodiment.

A copy magnification can be set by operating keys 204*a* and 204*b* by the input pen 188. The set copy magnification is displayed on a magnification displaying portion 206 as shown in FIG. 6 as "127%", for example.

Modes other than the mode for setting an editing function and a mode for setting a copy magnification can be set by cursor keys 208*a* and 208*b* for moving a cursor and a change key 210 for changing an item designated by the cursor. More specifically, when the cursor key 208*a* is operated a portion of cursor indicators 212*a*–212*s* to be lightened is moved rightward on the LCD 192.

For example, when a cursor indicator 212*s* is lightened, if the cursor key 208*a* is further operated, a cursor indicator 212*a* is lightened. Then, if the cursor key 208*a* continues to be operated, cursor indicator to be lightened is sequentially moved rightward as a function of the number of times of operations.

For example, when the cursor indicator 212*g* is lightened and the cursor key 208*b* is operated a cursor indicator to be lightened is returned to 212*f*. Then, if the cursor key 208*b* continues to be operated, a cursor indicator to be lightened is sequentially moved leftward as a function of the number of times of operations.

Figure 3:
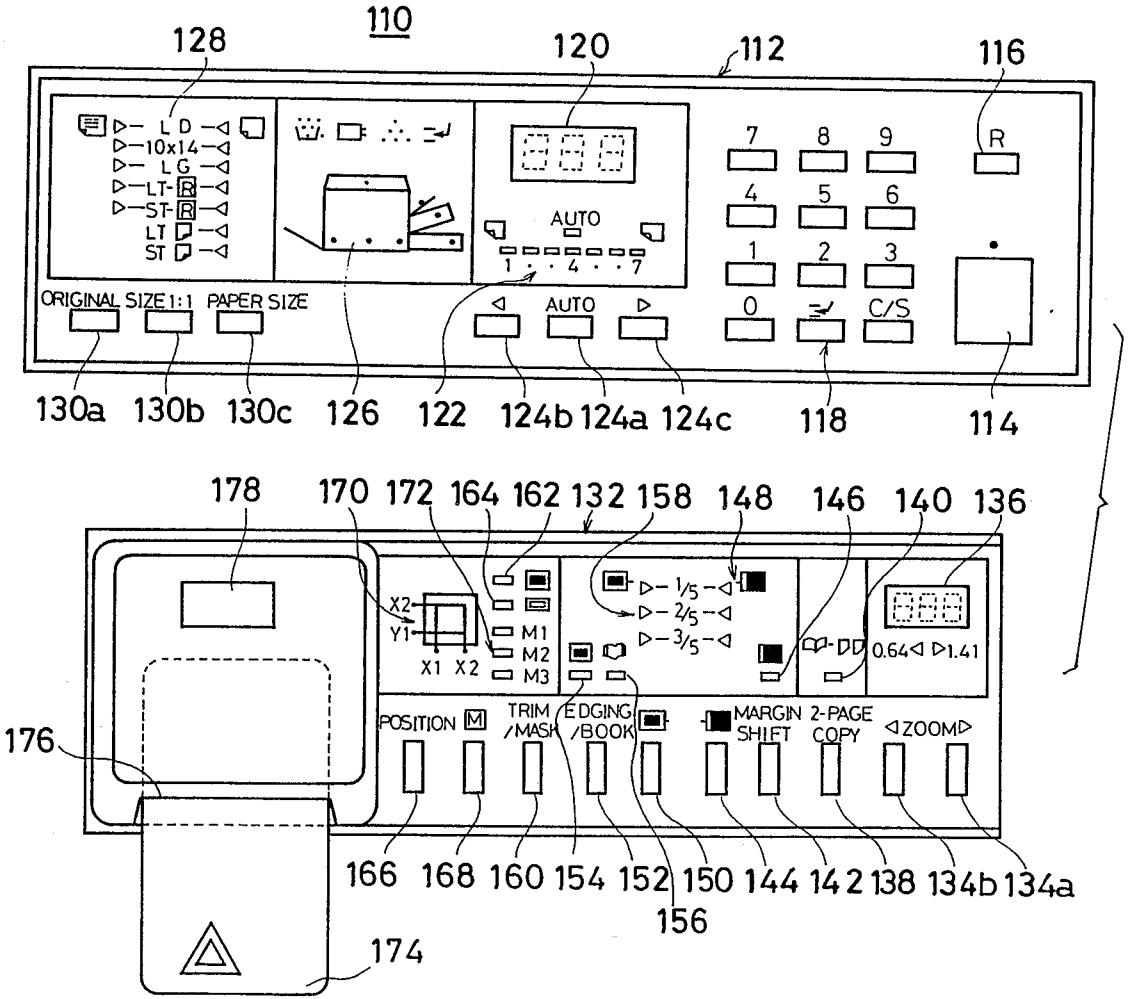
FIG. 3 is an illustrative view showing an operating panel of a copying machine main unit.

If the cursor indicator to be lightened out of the cursor indicators 212*a*–212*s* is set by the cursor keys 208*a* and 208*b*, an item capable of being inputted is decided. In that state, if the change key 210 is operated, a function or a data of a numeral value is changed within the selected item. For example, in the state where the cursor indicator 212*g* is lightened and "LD" is displayed on an original size displaying portion 214 is "LD", when the change key 210 is operated by three times a displaying of the original size displaying portion 214 is change to "LTR" as shown in FIG. 6, whereby a size data of the original 18 put on the tablet 184 is inputted into the editor board 180. In addition, characters being displayed on the original size displaying portion 214 are coincident with characters written in the size indicator 128 as shown in FIG. 3.

On a paper size displaying portion 216, a size of a paper selected by the change key 210 is displayed. Characters being displayed on the paper size displaying portion 216 are also coincident with characters written in the size indicator 128 as shown in FIG. 3.

When any characters are displayed on the original size displaying portion 214 and the paper size displaying portion 216 a copy magnification is automatically set and the copy magnification as automatically set is displayed on a magnification displaying portion 206. In addition, when the copy magnification is automatically set, that is, when any characters are displayed on the original size displaying portion 214 and the paper size displaying portion 216 no change occurs on the magnification displaying portion 206 even if the cursor indicator 212*i* is lightened and the keys 204*a* and 204*b* for manually setting a magnification is operated by the input pen 188. this means that since a magnification is automatically set in that time, keys 204*a* and 204*b* for setting a magnification are disabled.

A copy quantity displaying portion 218 displays a set copy quantity. When a digit of hundreds is to be set the cursor indicator 212*i* is lightened by the cursor key 208*a* or 208*b* and thereafter, a desired numeral value out of "0–9" is set by operating the change key 210. Likewise, when a digit of tens and a digit of units are to be set the cursor indicators 212*k* and 212*m* are respectively lightened and thereafter the change key 210 may be operated.

A density displaying portion 220 corresponds to the density indicator 122 of seven notches as shown in FIG. 3 and a change of the density is made by operating the change key 210 in the state where the cursor indicator 212*n* is lightened.

A margin displaying portion 222 corresponds to three LEDs 148 as shown in FIG. 3 and shift margin of three notches is selected by operating the change key 210 in the state where the cursor indicator 212*p* is lightened.

A edging/book displaying portion 224 displays either an edging mode or book mode is set. When either the edging mode or the book mode should be set the cursor indicator 212*r* is lightened by the cursor keys 208*a* and 208*b* and thereafter the edging mode or the book mode is selected by operating the change key 210.

In addition, likewise when the edging width of the edging mode is set a position being lightened of three LEDs 158 as shown in FIG. 3, when the edging mode is selected it is necessary to select any one of edging widths of three notches. In this time, the cursor indicator 212*p* is lightened by operating the cursor key 208*b* one time and, thereafter the edging width is decided by operating the change key 210.

A 2-page copy displaying portion 224 is a displaying portion having means similar to the LED 140 as shown in FIG. 3. More specifically, when one sheet of original 18 should be separately copied onto two sheets of papers, the cursor indicator 212*s* is lightened, and thereafter displaying just above the cursor indicator 212*s* is set as "Y" by operating the change key 210. Therefore, when one sheet of original should be copied onto one sheet of paper, the displaying just above the cursor indicator 212*s* is set as "N".

A point displaying portion 228 displays whether or not an area for "trimming" or the like is set. That is, an area for such as "trimming" in the editing mode is set by designating two points of the rectangle by means of the input pen 188. When the rectangular area is set, first, the cursor indicator 212*b* is lightened and thereafter a desired portion on the original 18 put on the tablet 184 is depressed by the input pen 188. The coordinates of the left lower corner of the rectangle is thus set, a mark "*" is lightened just above the cursor indicator 212*b*. Then, if the input pen 188 is operated after lightening of the next cursor indicator 212*c*, likewise, the coordinates of the right upper corner of the rectangular area is set, and the mark "*" is lightened above the cursor indicator 212*b*. Thus, when the editing area for "trimming" or the like is set the mark "*" is displayed on the respective portions.

A message displaying portion 230 displays a message for example "error" if a mistake occurs in operating the group of operating keys 186.

An area memory displaying portion 232 is a portion for displaying that the editing area for "trimming" or the like has been stored. More specifically, it is possible to confirm that one area for "trimming" or the like has been set by lightening the mark "*" of the respective portions of the point displaying portion 228. When when a further area to be edited should be set it is necessary to store the area where has been set. In this time, if the change key 210 is operated one time after lightening the cursor indicator 212*d*, a portion just above the cursor indicator 212*d* is lightened and the mark "*" of the respective portions of the point displaying portion 228 are put out. Thus, the area to be edited where has been set is stored in the editor board 180 and, then it is possible to set a further area. When a second and a third area should be stored two marks "*" of the point displaying portion 228 are confirmed and thereafter the change key 210 may be operated so as to store that areas after lightening the cursor indicators 212*e* and 212*f*, respectively.

In confirming of the stored area and etc. of a copy condition information, a key 236 at the right side of a key 234 as shown in FIG. 5 is operated. Then, an area to be edited which is stored in the editor board 180 is called and two marks "*" are lightened on the point displaying portion 228. The area should be called by operating the key 236 can be designated by operating cursor key 208*a* or 208*b* to lighten any of the cursor indicators 212*d*–212*f*.

In addition, in this embodiment, the rectangular area to be edited such as "trimming" is designated by specifying two points by the input pen 188; however, in the case where the area can be inputted by six points of L-letter shape, it is necessary to confirm that the stored area is designated by two points or by six points.

A key 238 as shown in FIG. 5 is a clear key which is to be operated when the set functions or conditions should be released in the case where misoperation occurs in setting the above described copy condition, for example. A key 240 at the right side of the clear key 238 is an all reset key which is used when all of the functions or conditions stored in the editor board 180 should be released as different from the clear key 238 which is used when the functions or conditions should be partially released. Therefore, the reset key 240 may be operated when the data remaining in the editor board 180 should be erased prior to newly setting of the copy condition information.

Figure 7:
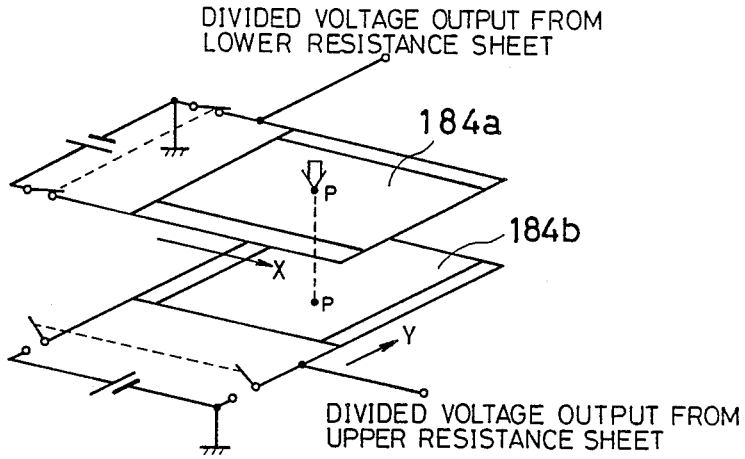
FIG. 7 is an illustrative view showing a structure of a tablet.

Next, in reference to FIG. 7, description is made in connection with the tablet. The tablet 184 includes a surface sheet as an input surface, and an upper resistance sheet 184*a* for detecting coordinates of an X direction and a lower resistance sheet 184*b* for detecting a Y direction which are arranged so that respective resistance surfaces is faced to each other via an insulating layer.

Figure 8:
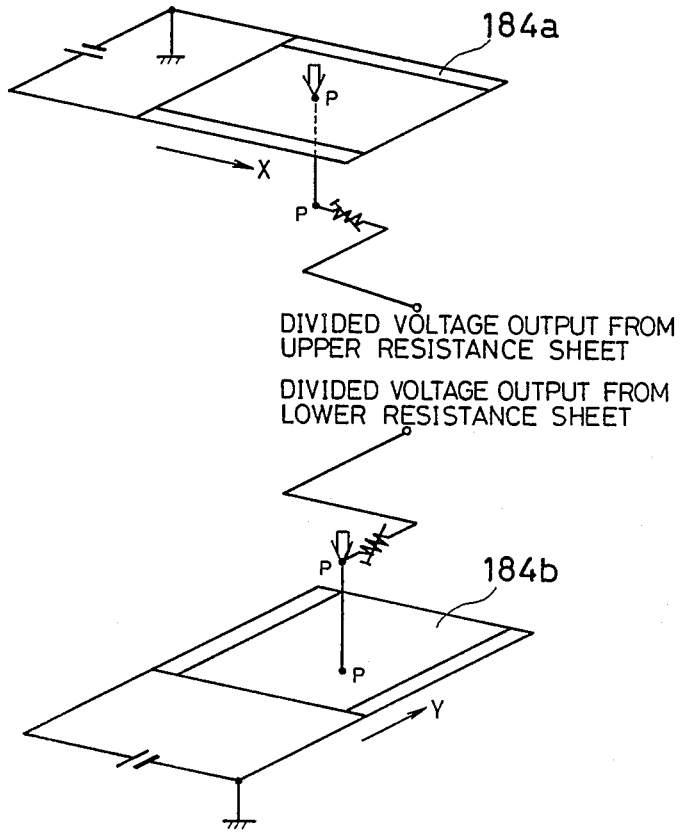
FIG. 8 is an explanatory view showing an operation of the tablet as shown in FIG. 7.

In reference to FIG. 8, when the surface of the surface sheet is depressed by the input pen 188(FIG. 4) the upper resistance sheet 184*a* and the lower resistance sheet 184*b* are contacted with each other and electrically connected at a depressed point P. In this state, if a voltage is applied between electrodes of the upper resistance sheet 184*a*, a divided voltage at the depressed point P is outputted from an electrode of the lower resistance sheet 184*b*. The voltage thus obtained is converted into a digital data of "0"–"255" by means of an 8-bit A/D converting IC 256 as shown in FIG. 8 and the data becomes a positional data of the X ordinate.

Next, if the voltage being applied to the upper resistance sheet 184*a* is changed over to be applied between electrodes of the lower resistance sheet 184*b*, since a divided voltage at the depressed point is outputted from the electrode of the upper resistance sheet 184*a*, as like above, a positional data of the Y ordinate is obtained.

Figure 9:
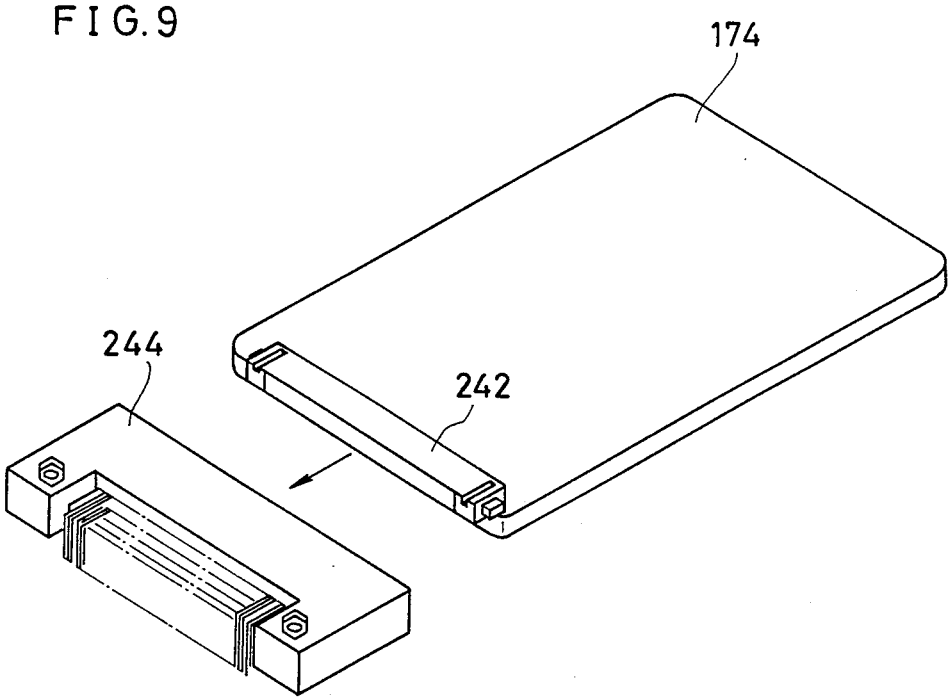
FIG. 9 is a perspective view showing an IC card as one example of a storage medium.
Figure 10:
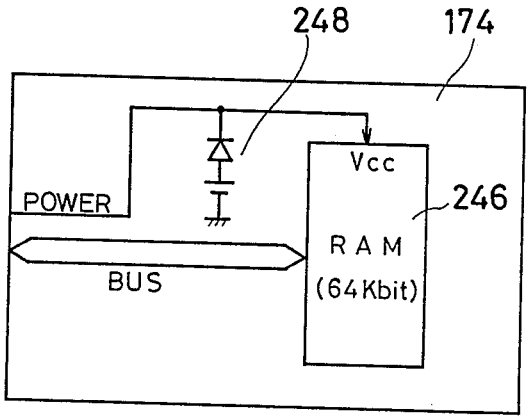
FIG. 10 is a block diagram showing a structure of the IC card as showing in FIG. 9.

FIG. 9 is a perspective view showing an IC card as one example of a storage medium, and FIG. 10 is a block diagram thereof. A receptacle connector 242 is fixed at the front end of the IC card 174 so as to be able to insert or pull out to or from a header-type connector 244 which is provided in the card insertion portions 186 and 190 of the copy machine main unit 12 and the editor board 180, respectively. The header-type connector 244 may be connected to control portions of the copying machine 12 and the editor board 180, respectively.

A RAM 246 of 64-Kbit is incorporated in the IC card 174, which transfers or receives a data and a control signal to or from the control portion via the connectors 242 and 244. The RAM 246 is backed up by a lithium battery 248 connected to a power terminal Vcc and data written into the RAM 246 is held even in the state where the IC card 174 is pulled out from the header type connector 244.

Figure 11:
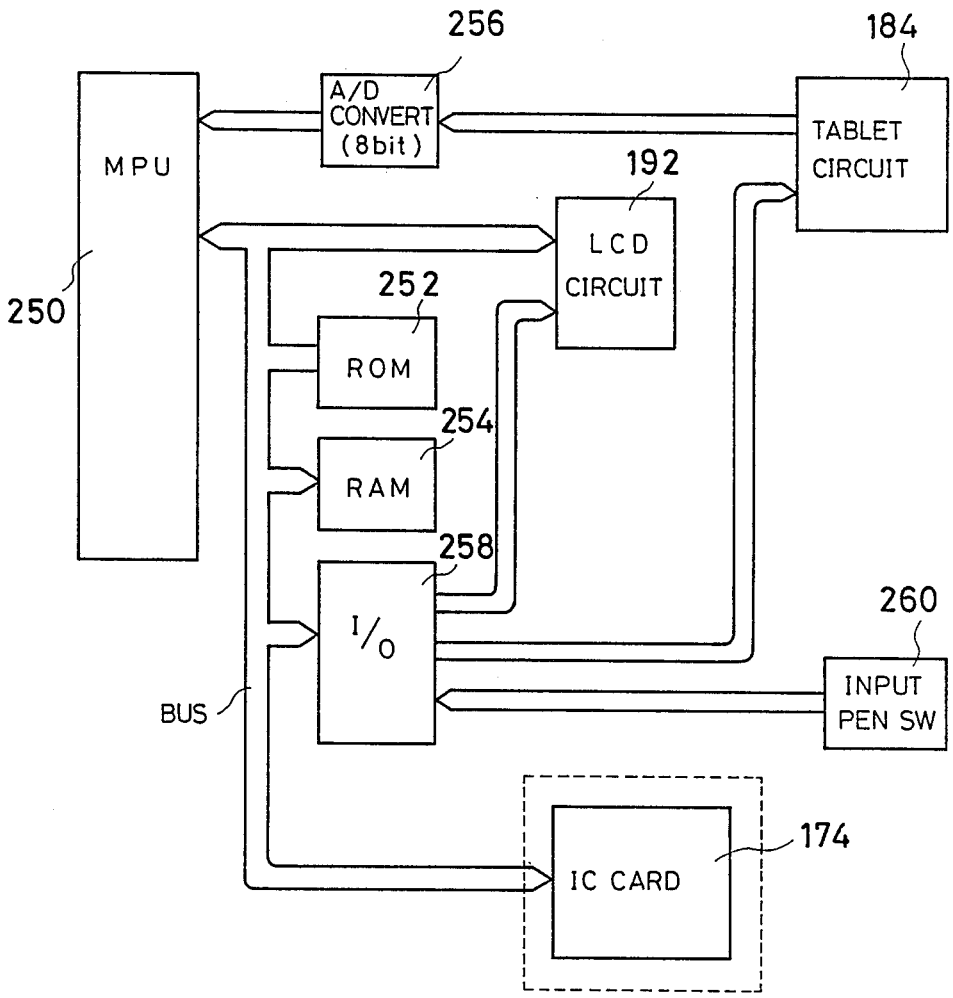
FIG. 11 is a block diagram of an editor as shown in FIG. 4.

FIG. 11 is a block diagram of a control portion of the editor. The editor is controlled by a microcomputer system including a microprocessor (hereinafter "MPU") 250. The microcomputer system includes, other than the MPU 250, a RAM 252 being connected to the MPU 250 and for storing a control program and so on, a RAM 254 for temporarily storing data in controlling by the MPU 250 and having areas for various flags necessary in controlling, the A/D converting IC 256 which converts the voltage given from the tablet 284 into the digital data, and an I/O interface 258 for outputting control signals from the MPU 250 to the tablet circuit 284 and the LCD 192. A switch 260 is incorporated in the input pen 188, which may be a tact switch, for example, and is turned on by depressing the tip end of the input pen 188, and an output of the switch 260 is inputted to the I/O interface 258.

Likewise the ROM 252, ROM 254 and I/O interface 258, the RAM 246 included in the IC card 174 is connected to the MPU 250 through an address bus, data bus and control bus (generally called "bus").

Next, prior to description on operation, description is made on outlines of "trimming", "masking" and "moving" in reference to FIG. 12A through FIG. 14B.

Figure 12A:
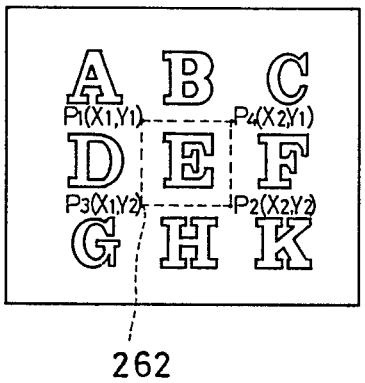
FIG. 12A and FIG. 12B are illustrative views showing "trimming".
Figure 12B:
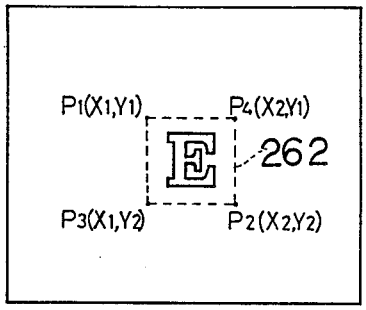

In "trimming", as shown in FIG. 12A, only a portion of the image corresponding to a rectangular area 262 formed by connecting four (4) designated points $P_1(X_1, Y_1)$, $P_3(X_1, Y_2)$, $P_2(X_2, Y_2)$ and $P_4(X_2, Y_1)$ is left intact, and the remaining portion of the image is erased as shown in FIG. 12B. Accordingly, in this mode, a plurality of LED elements 50, 50,—comprised in the LED array 46 are lightened only outside of the area 262.

Figure 13A:
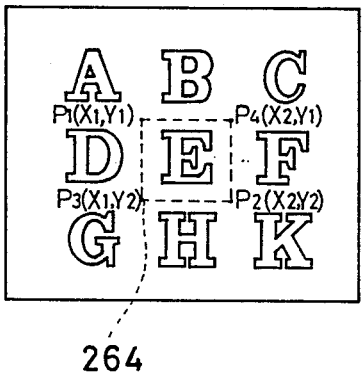
FIG. 13A and FIG. 13B are illustrative views showing "masking".
Figure 13B:
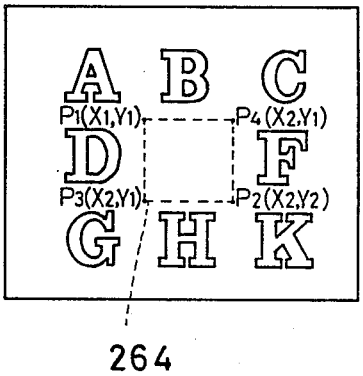

In "masking", as shown in FIG. 13A, only a portion of the image corresponding to a rectangular area 264 formed by connecting four designated points $P_1(X_1, Y_1)$, $P_3(X_1, Y_2)$, $P_2(X_2, Y_2)$ and $P_4(X_2, Y_1)$ is erased, and the remaining portion of the image is left intact as shown in FIG. 13B. Accordingly, in this mode, a plurality of LED elements 50, 50,—comprised in the LED array 46 are lightened only in the area 264.

Figure 14A:
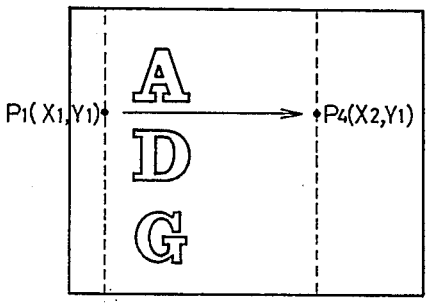
FIG. 14A and FIG. 14B are illustrative views showing "moving" to which the present invention is directed.
Figure 14B:
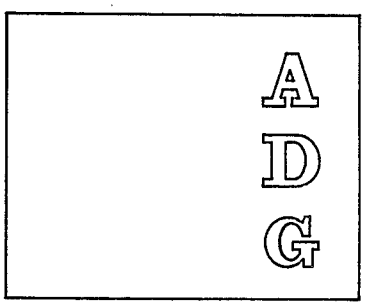

In "moving", as shown in FIG. 14A, coordinates $P_1(X_1, Y_1)$ of the front end or the rear end of the image to be moved are designated, and thereafter coordinates $P_4(X_2, Y_1)$ of the point whereto the image is to be moved with Y ordinate kept constant are designated. Then, the position $X_1$ on X ordinate moves to $X_2$ when the toner image is transferred onto the copy paper, and the moved image as shown in FIG. 14B is formed. This means that in this mode, as described later, timing of feeding paper is controlled by the coordinates while the LED array 46 is not used.

Figure 15:
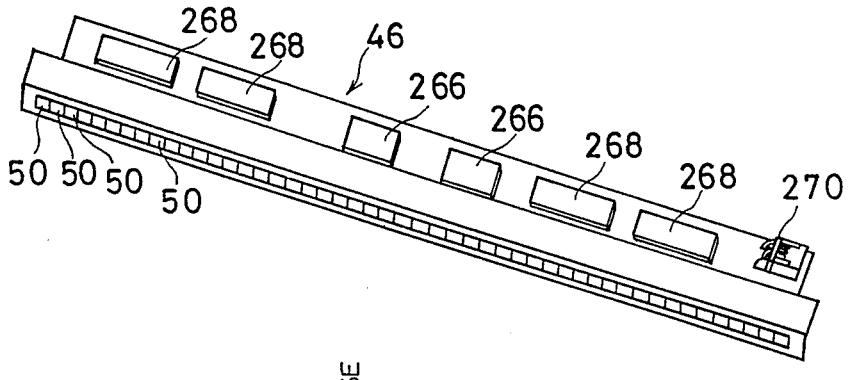
FIG. 15 is a perspective view of an LED array as one example of a partial erasure lamp.
Figure 16:
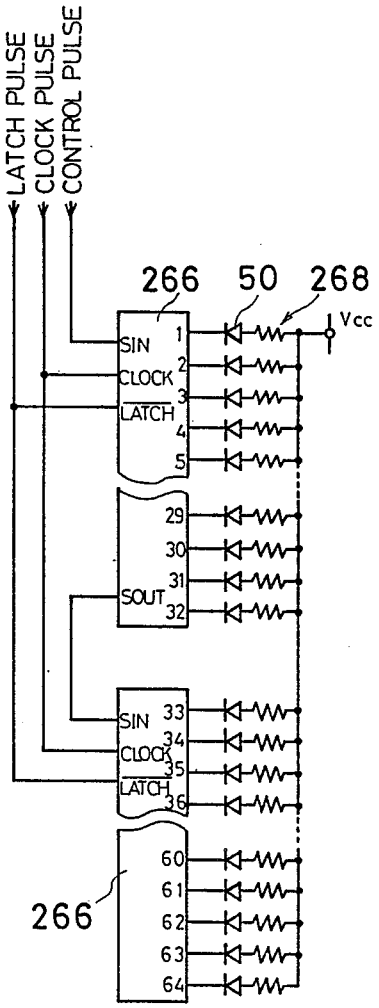
FIG. 16 is a circuit diagram of the LED array as shown in FIG. 15.

Here, description is made on the LED array 46 in reference to FIG. 15 and FIG. 16. As shown in FIG. 15, the LED array 46 includes a rod-shaped unit on which, for example, sixty four (64) LED elements 50, 50,—are arranged closely in the lateral direction. Driver ICs 266 for controlling lightening of the respective LED elements 50, resistance arrays 268 for adjusting the supplying voltage to the respective LED elements 50 and a connector 270 are further installed on the LED array 46. The LED elements 50, the driver ICs 266 and the resistance array 268 are connected as shown in FIG. 16.

Lightening of the LED elements 50, 50,—is controlled by pulses supplied to input terminals SIN, CLOCK and LATCH of the respective driver ICs 266. When the LED elements 50 are to be lightened to remove the charges on that portion of the photosensitive drum 38, a control pulse is given through the input terminal SIN in synchronous with the clock pulse so that the output terminal of the respective driver ICs 266 to which the LED elements 50 to be lightened are connected go to the high level. Then, when the latch pulse is supplied through the input terminal LATCH, the output terminal of the respective driver ICs 266 to which the LED elements 50 to be lightened are connected is kept high, and therefore the LED elements 50 hold the lightened state.

To lighten all of sixty four (64) LED elements 50, all the control pulses for sixty four (64) elements supplied through the input terminal SIN have only to go to the low level and all the low levels have only to be held by the latch pulse.

Also, in "masking" as described later, the LED elements 50 between the two points to be masked are lightened for a predetermined time, and in "trimming", only the LED elements 50 between the two points are put out and the LED elements 50 outside them are lightened. In addition, lightening/putting-out of such LED elements 50 is controlled by converting the data of Y ordinate obtained by the above-described editor into the positional data of sixty four (64) LED elements.

Next, description is made on operations or actions of the group of operating keys 186 of the editor board 180 based on flowcharts as shown in FIG. 17A through FIG. 17D with reference to FIG. 4 through FIG. 6. The operation of the group of operating keys 186 are controlled by an interrupting process of the MPU 250.

Figure 17A:
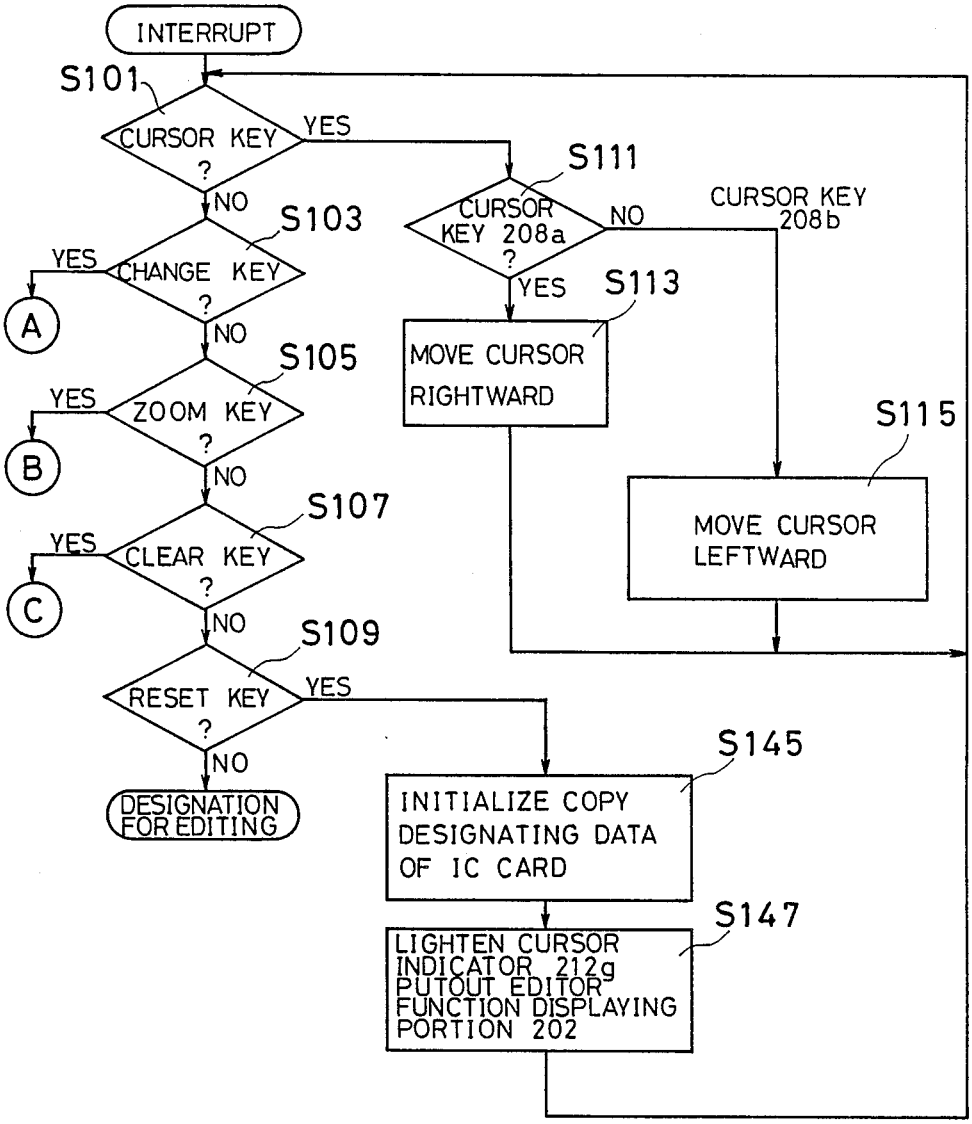
FIG. 17A FIG. 17D are flowcharts showing operations or actions or actions of keys other than an editing mode of an editor.

In FIG. 17A, it is determined whether or not any of key out of the group of operating keys 186 is operated in the steps S101 through S109.

If it is determined that the cursor keys 208*a* and 208*b* are operated in the step S101, the process proceeds to the step S111. In the step S111, it is determined whether or not the operated key is the cursor key 208*a*. If determined that the operated key is the cursor key 208*a*, the process proceeds to S113 and, if determined that the operated key is not the cursor key 20*a*, that is, when the cursor key 208*b* the process proceeds to step S115.

In the step S113, a position to be lightened of the cursor indicator 212*a*–212*s* as shown in FIG. 6 is sequentially moved rightward as a function of the number of times of operations of the cursor key 208*a*. Reversely, in the step S115, a position to be lightened of the cursor indicator 212*a*–212*s* is sequentially moved leftward as a function of the number of times of operations of the cursor key 208*b*.

Figure 17B:
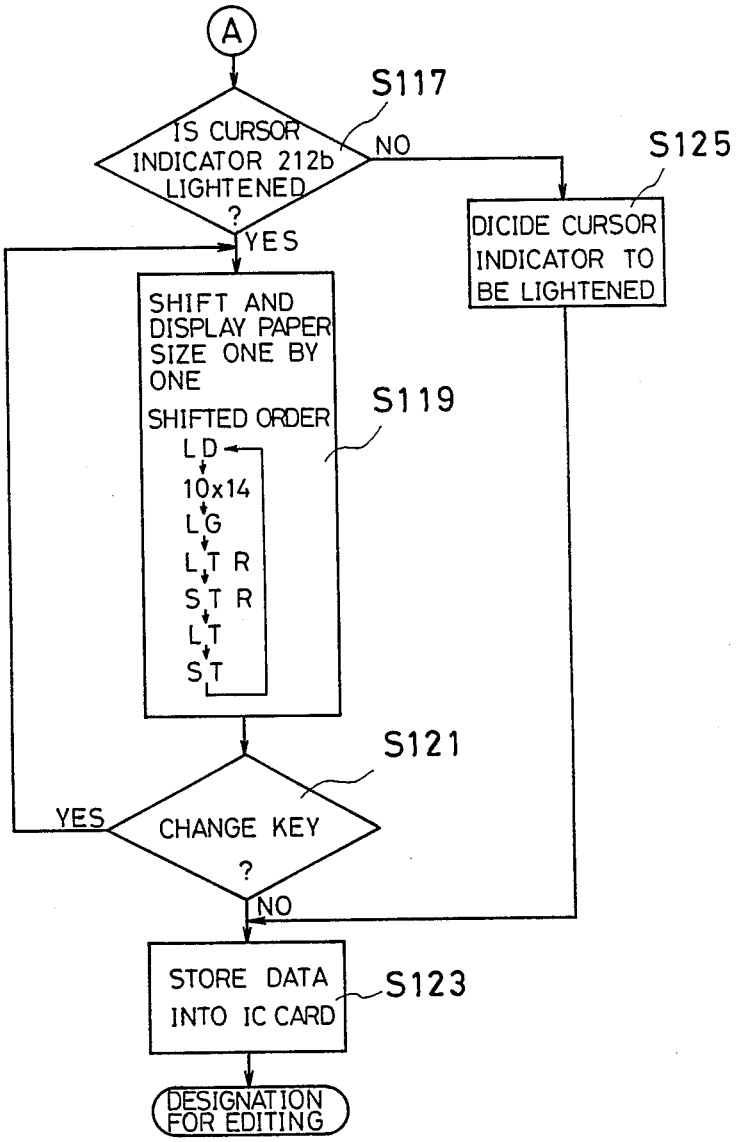

In the step S103, determination is made on whether or not the change key 210 is operated after designating of the cursor indicator to be lightened by the cursor keys 208*a* and 208*b*. If the cursor indicator 212*h* is lightened in the step S103, next, the process proceeds to the step S119 as shown in FIG. 17B. In the step S119, the selected size of the paper is displayed on the paper displaying portion 216 of the editor board 180. Characters being displayed in that time are same as the characters indicated in the size indicator 128 of the copying machine main unit 12.

In the next step S121, it is determined whether or not the change key 210 is further operated by the input pen 188. Upon confirmation of the operation, the process returns to the previous step S119. Then, in the step S119, responsibly, a displaying of the paper size displaying portion 216 is shifted in accordance with a predetermined shifting order as shown in the step S119 of FIG. 17B.

In the case where the change key 210 is not operated in the step S121, in the step S123, the data of the paper size displayed and selected in the step S119 is stored in the RAM 246 of the IC card 174.

In the case where the cursor indicator 212*h* is not lightened in the first step S101, the process proceeds to the step S125 from the step S117 of FIG. 17B. In the step S125, a position to be lightened of the cursor indicators 212*a*–212*s* is decided in accordance with the number of operation times of the cursor key 208*a* or 208*b*. Then, data corresponding to the decided cursor indicator is also stored in the IC card 174 in the next step S123.

Figure 17C:
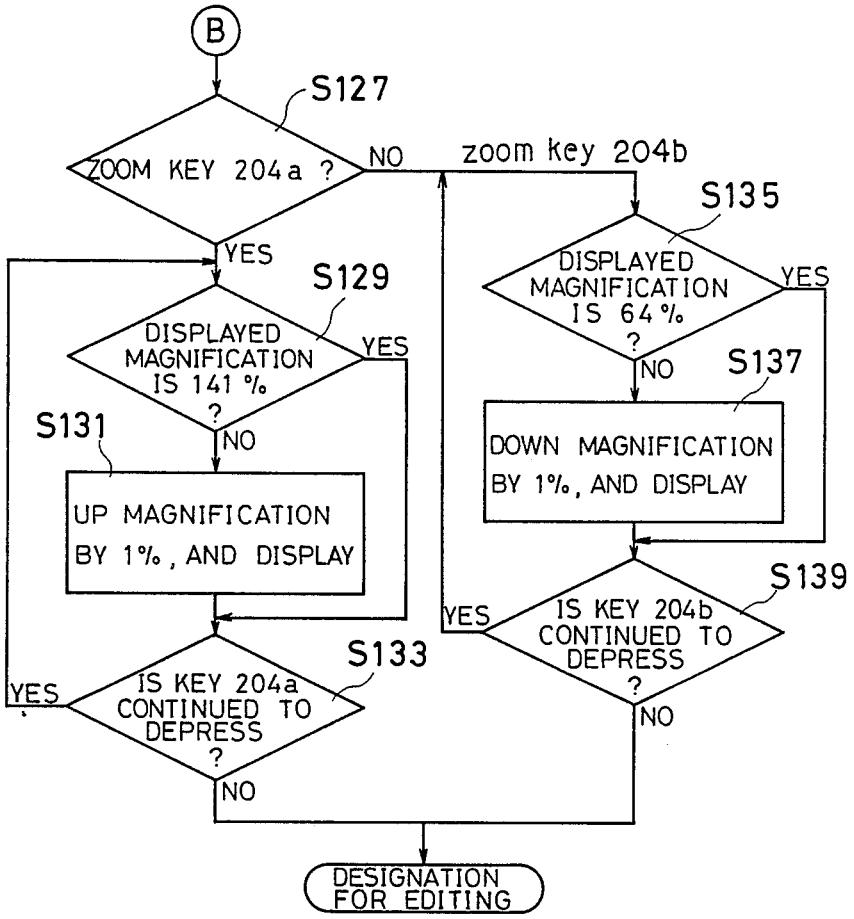

In the case where that the zoom key 204*a* or 204*b* is operated in the step S105, next, the process proceeds to the step S127 as shown in FIG. 17C. In the step S127, it is determined whether or not the operated zoom key is 204*a*. If zoom key 204*a*, the process proceeds to the step S129.

In the step S129, it is determined whether or not the copy magnification is the upper limit of the enlargement in the copy machine main unit 12, 141%, for example. If the magnification displayed on the magnification displaying portion 206 is 141%, the process proceeds to the S133. If the magnification displayed on the magnification displaying portion 206 is smaller than 141%, that is, in the case where the copy magnification is able to be changed larger, the process proceeds to the step S133 through the step S131. In the step S131, 1% is added to the magnification presently displayed on the magnification displaying portion 206, and being displayed. In the step S133, it is determined whether or not the zoom key 204*a* continues to be depressed. If continues, the process returns to the step S129 and repeats the step S129 through the step S133. Accordingly, if it is confirmed that the maximum enlargement magnification, i.e. 141% has been set, no change occurs in a displaying of the magnification of the magnification displaying portion 206 even if the zoom key 204*a* continues to be depressed by the input pen 188 in the step S133 and, a setting of the enlargement magnification larger than that is prohibited.

In the case where the operated zoom key is not 204*a* in the step S127, that is, in the case where the operated zoom key is 204*b*, the process proceeds to the step S135. In the step S135, it is determined whether or not the magnification displayed on the magnification displaying portion 206 is the lower limit of the reduction magnification, 64%, for example. If the magnification is 64% presently displayed on the magnification displaying portion 206, the process proceeds to the step S139 from the step S135.

In the case where the magnification displayed on the magnification displaying portion 206 is larger than 64%, that is, in the case where the magnification is able to be set further reduction, the process proceeds to the step S139 through the step S137. In the step S137, 1% is subtracted from the magnification presently displayed on the magnification displaying portion 206, and being displayed.

In the next step S139, it is determined whether or not the zoom key 204*b* continues to be depressed by the input pen 188. If continues, the process returns to the step S135 and repeats the step S135 through the step S139. Accordingly, if it is confirmed that the minimum reduction magnification, 64% has been set, no change occurs in a displaying of the magnification displaying portion 206 even if the zoom key 204*b* continues to be depressed by the input pen 188 in the step S139 and, a setting of the reduction magnification smaller than that is prohibited.

Figure 17D:
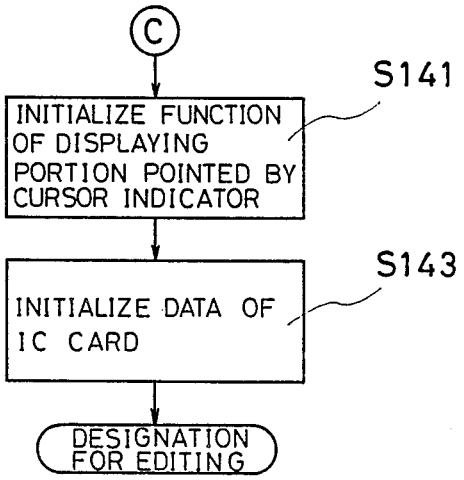

Next, in the step S107 of FIG. 17A, it is determined whether or not the clear key 283 as shown in FIG. 5 is operated. If confirmed that the clear key 238 is operated in the step S107, the process proceed to the step S141 as shown in FIG. 17D.

In the step S141, if the cursor displaying portion 212*g* is lightened and a displaying on the original size displaying portion 214 is "LTR", the displaying of the original size displaying portion 214 is returned to "LD" when the clear key 238 is operated. This means that even in the case where the size of "LTR" of the paper is selected by operating the change key 210, upon an operation of the clear key 238, such a selecting function of the paper size is initialized and returned to the initially set status.

Next, by operating the clear key 238, the data of the IC card 174 is also initialized in the step S143.

Returning to FIG. 17A, in the step S109, it is determined whether or not the reset key 240 is operated. If the reset key 240 is operated, the process proceeds to the step S145. In the step S145, the data of the IC card 174 is wholly cleared and becomes initialized status which is same status that the IC card 174 is first loaded to the editor board 180.

In the next step S147, if any of the cursor indicators 212*a*–212*s* is lightened, a lightening of that is changed over and then the cursor indicator 212*g* is lightened, and "Trimming" is putted out in the case where "Trimming" was displayed on the function displaying portion 202.

Figure 18A:
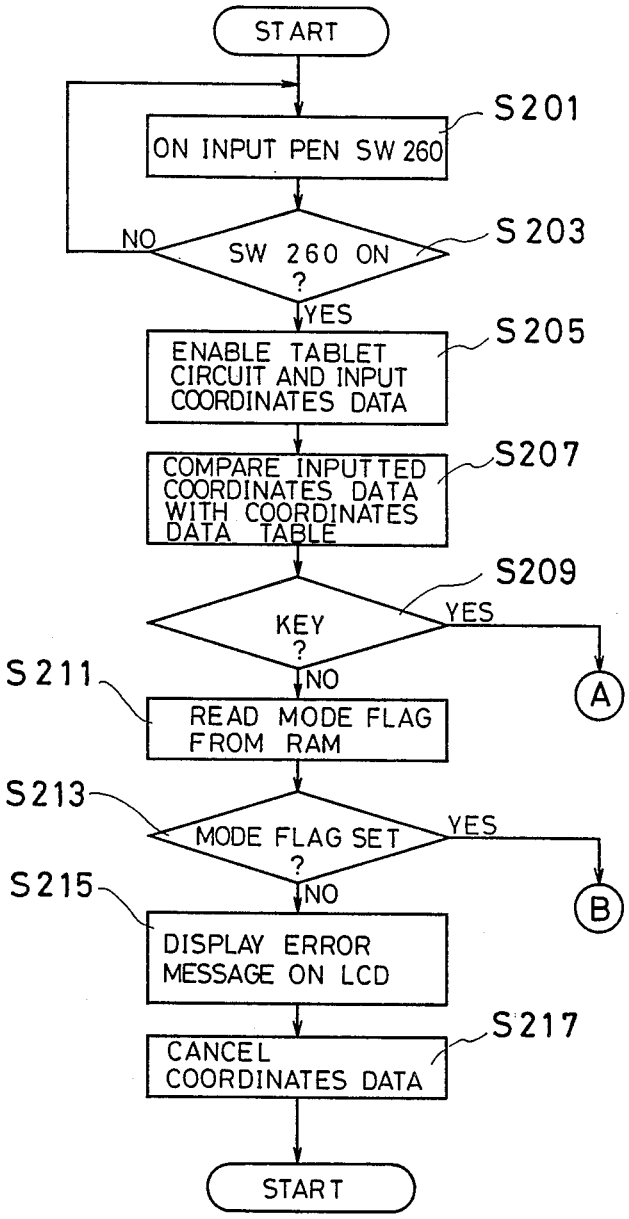
FIG. 18A through FIG. 18C are flowcharts showing operations of the editor in the editing mode.
Figure 18B:
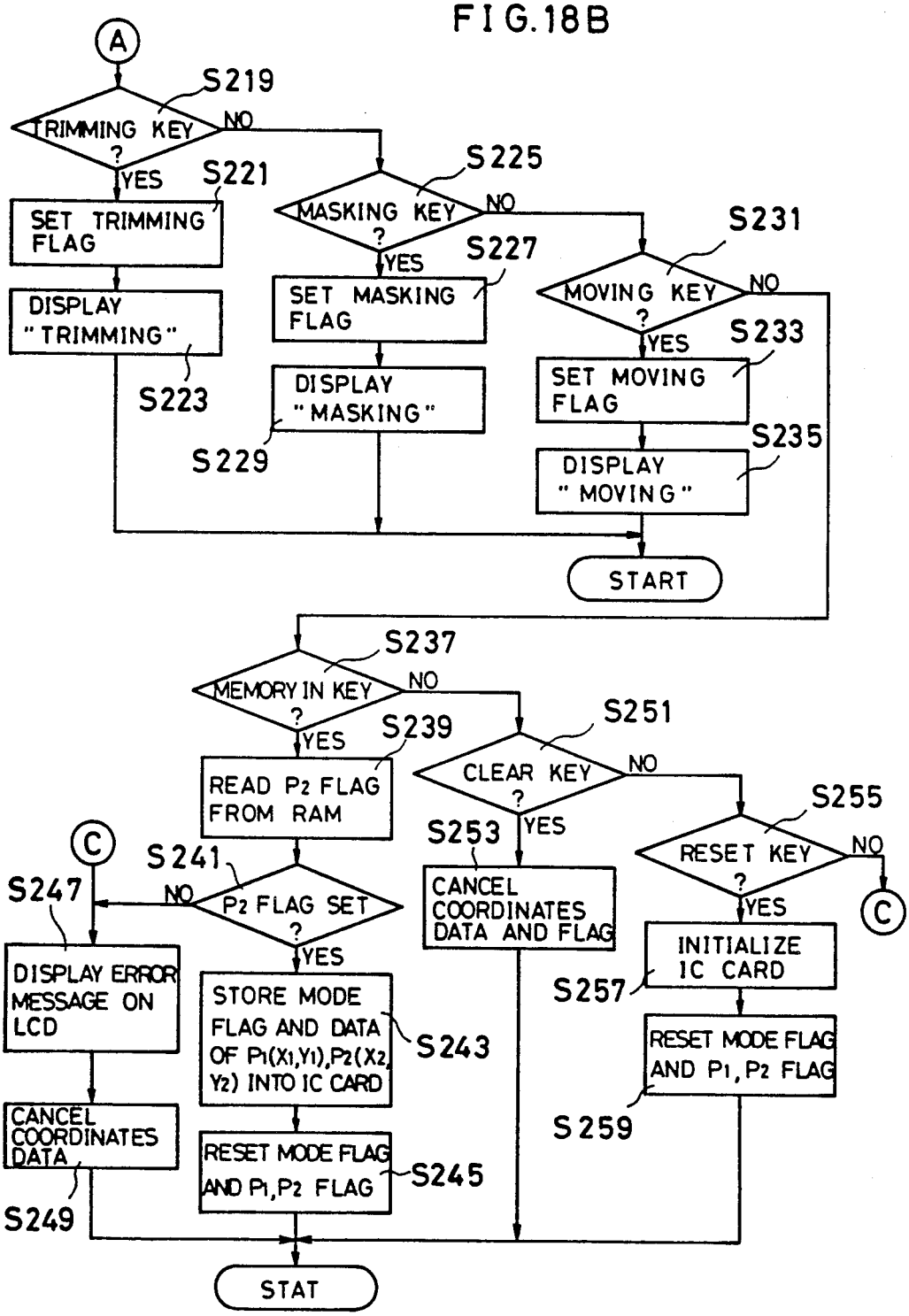
Figure 18C:
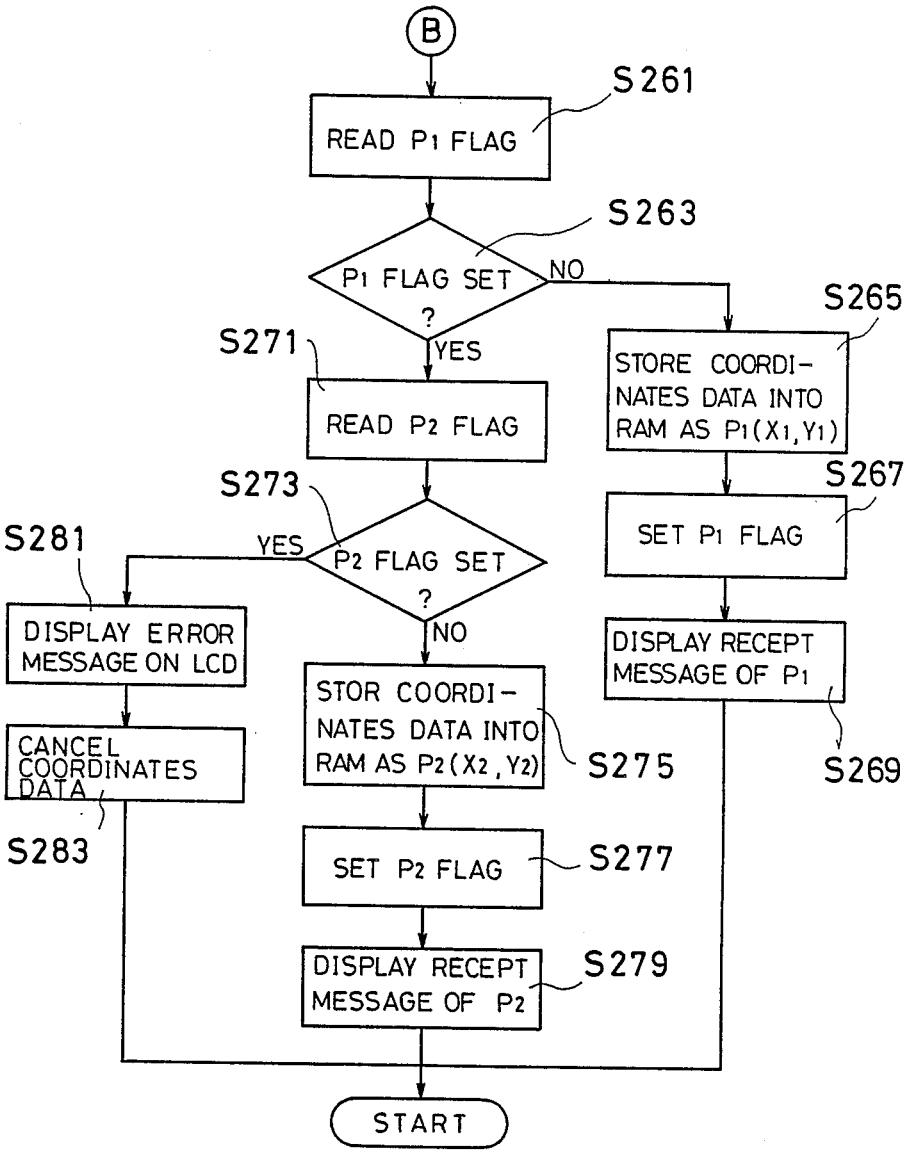

Now, description is made on operations or actions in the editing mode using the editor based on flowcharts as shown in FIG. 18A through FIG. 18C.

First, the editing function is designated by depressing any of the editing function keys 194 through 200 of the editor board 180 by the input pen 188. In the steps S201 through S203, the MPU 250 always senses a state of the input pen switch 260, upon turning on of the switch 260, the process proceeds to the step S205 and it is started to read the coordinates of a position being depressed by the input pen 188.

In the step S205, the MPU 250 drives to enables the tablet circuit 184 through the I/O interface 258, and the coordinates data of the position depressed by the input pen 188 is inputted in the manner of the afore-mentioned method for detecting the position of the coordinates as shown in FIG. 8. In the next steps S207 through S209, the MPU 250 compares the coordinates data table of keys stored in the ROM 252 in advance with the detected coordinates data which is inputted by the input pen 188, and if the detected coordinates data is the coordinates of any key, the process proceeds to the step S209. If the data is not the coordinates of keys, the process proceeds to the steps of S211 through S213 and, the MPU 250 reads an editing mode flag from the RAM 254 and determines whether or not any of the editing function of the editing mode has been designated.

If any of the editing mode flag is set in that time, the coordinates data may be the positional data of the area to be edit in the editing mode and therefore the process proceeds to the step S261. If no editing mode flag is set, the process proceeds to the steps S215 through S217 and the coordinates data is canceled as that of mis-operation or an error data by a noise in a data line, at the same time, a message "error" is displayed on the message displaying portion 230 of the LCD 192 (FIG. 6).

If the operator depresses the trimming key 194, the process proceeds to the step S219. In the step S219, the coordinates data is compared with the coordinates data of the trimming key 194. If both data are coincident with each other, the MPU 250 determines that "trimming" is designated as the editing function and proceeds to the step S221. In the step S221, in order to store that "trimming" is designated, a trimming flag is set in the RAM 254. Then, in the step S223, "Trimming" is displayed on the LCD 192. If the coordinates data is not of the trimming key 194, the process proceeds to the steps S225, S231, S237,—and respective key processings are executed.

When the masking key 196 is depressed by the input pen 188 the steps S220 and S229 are executed, and a masking flag is set and "Masking" is displayed on the LCD 192.

When the moving key 198 is depressed by the input pen 188, the steps S231 through S235 are executed, and a moving flag is set and "Moving" is displayed on the LCD 192.

Next, operator puts the original 18 on the tablet 184 so that the original surface is turned upward. In this time, the original 18 is put on so that the center of a width direction of the original is coincident with the center mark 181*a* of the editor board 180. Thereafter, the operator designates an area for trimming, for example, the points of $P_1$ and $P_2$ which are present at the opposite angles of the area 262 as shown in FIG. 12A by using the input pen 188. Since the trimming flag has been set, the process proceeds to the step S261. In the steps S261 through S263, a flag for storing that the point $P_1$ has been designated, that is, a $P_1$ flag is confirmed. Since the $P_1$ flag has not been set at the time point when the point $P_1$ is designated by the input pen 188, the process proceeds to the step S265. In the steps S265 through S269, the coordinates data $X_1$ and $Y_1$ of the point $P_1$ and the $P_1$ flag are stored in the RAM 254 and, in order to indicate that the data of the point $P_1$ is received, the mark "*" is displayed on the point displaying portion 228 of the LCD 192.

When the point $P_2$ is designated by the input pen 188 a $P_2$ flag is confirmed in the step of S271, since the $P_1$ has been set. The $P_2$ flag is not set at a time point when the point $P_2$ is designated and therefore the process proceeds to the step S275. In the steps of S275 through S279, likewise that of the point $P_1$, the coordinates data $X_2$, $Y_2$ and the $P_2$ flag are stored in the RAM 254 and, in order to indicate that the point $P_2$ is received, a second mark "*" is displayed on the point displaying portion 228.

In the case where the $P_2$ flag has been set in the step S273, that is, in the case where any points other than the key previously operated is newly operated after that operator designates the points $P_1$ and $P_2$, an error message "error" is displayed on the message displaying portion 230 of the LCD 192 as shown in the steps S281 through S283, and the coordinates data of that point is canceled.

Next, after designating of the points $P_1$ and $P_2$, operator depresses the memory-in key 234 by the input pen 188. Responsively, the MPU 250 determines the fact and the process proceeds to the step S239.

In the step S241, since the $P_2$ flag must has been set, the MPU 250 regards as that operations for editing has been completed and proceeds to the step S243. In the step S243, the editing mode flag (here, may be the trimming flag) and the coordinates data $X_1$, $Y_1$, $X_2$ and $Y_2$ of the points $P_1$ and $P_2$ which are stored in the RAM 254 are transferred and stored into the RAM 246 of the IC card 174. Then, in the step S245, the editing mode flag and the $P_1$ flag and $P_2$ flag in the RAM 254 are reset for next editing operation.

If the $P_2$ flag is not set in the step S241, the editing operation has not been completed and therefore as shown in the steps S247 through S249, a message "error" is displayed on the message displaying portion 230 and the coordinates data of the memory in key 234 is canceled. In the case where the operator made mis-operation and the data inputted just before should be canceled, the clear key 238 is depressed by the input pen 188, and then the canceling processing of the coordinates data and flag is executed in the step 253.

If the reset key 238 is depressed, in the step S257, the RAM 246 of the IC card 174 is initialized and the data concerning the editing mode is wholly cleared. At the same time, in the step S259, the editing mode flag and the $P_1$ flag and $P_2$ flag in the RAM 254 are reset.

Figure 19:
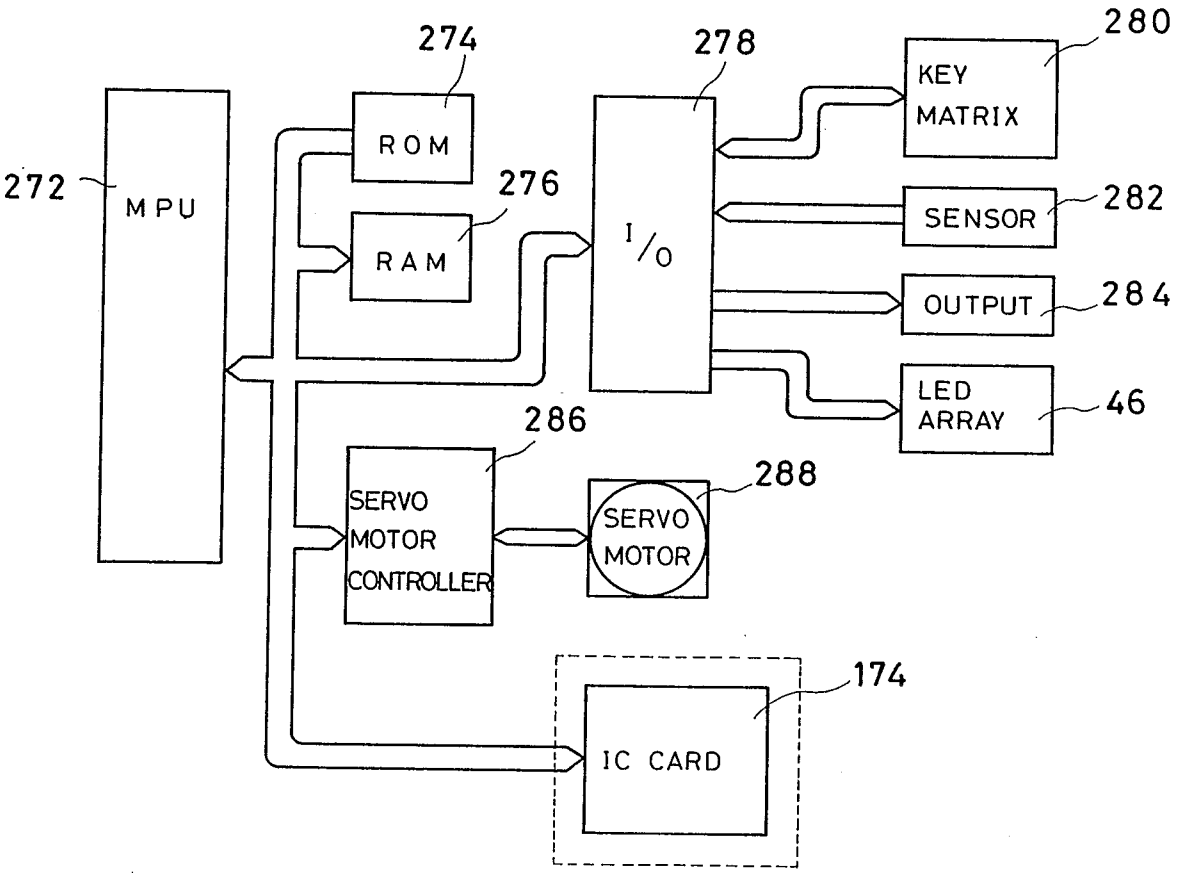
FIG. 19 is a block diagram showing a structure of the copying machine as shown in FIG. 1.

FIG. 19 is a block diagram of a control portion of the copying machine main unit. The copying machine is controlled by a microcomputer system including an MPU 272. The microcomputer system includes a ROM 274 connected to the MPU 272 and for storing a control program, a RAM 276 for temporarily storing data in controlling by the MPU 272 and having various flag areas necessary for controlling, and an I/O interface 278 for making the MPU 272 to control input and output to and from internal equipments of the main unit.

To an input port of the I/O interface 278, a data of a key matrix 280 of the operating panel 110 and output of a sensor circuit 282 including a paper size sensor are inputted.

To an output port of the I/O interface 278, a driving device 184 such a motor, solenoid and so on and the partial erasure lamp, that is, the LED array 46 for partially erasing the electrostatic latent image becoming useless by editing are connected. The operation of this LED array 46 is previously explained.

Furthermore, to the MPU 272, a servo motor controller (LSI) 286 is connected and, a DC servo motor 288 for reciprocally scanning the exposure lamp 28 is connected to the controller 286.

The RAM 246 within the IC card 174 is connected to the MPU 272 by a bus as same as the control portion of the editor.

Figure 22A:
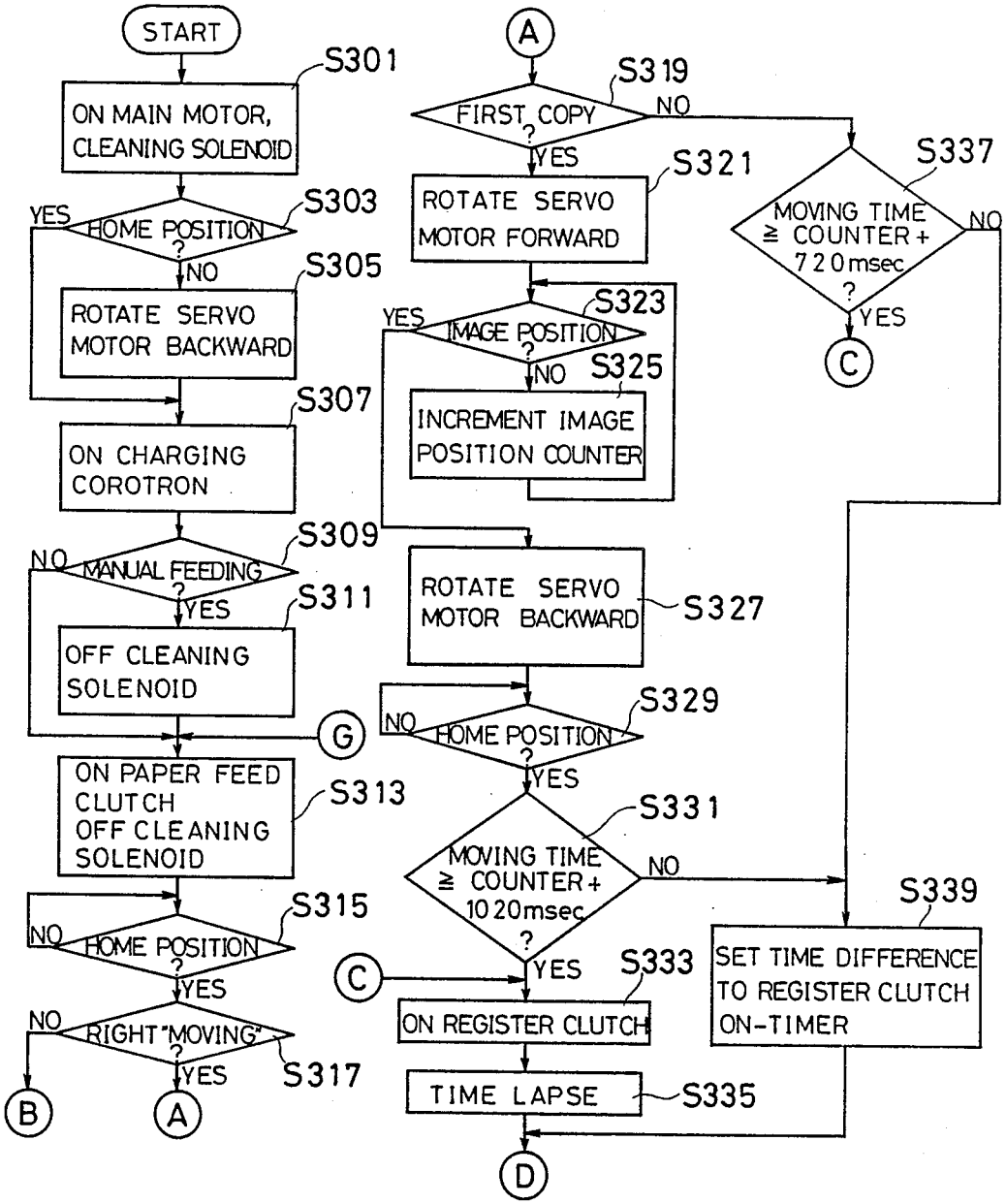
FIG. 22A through FIG. 22C are flowcharts showing operations of the copying machine of the embodiment.
Figure 22B:
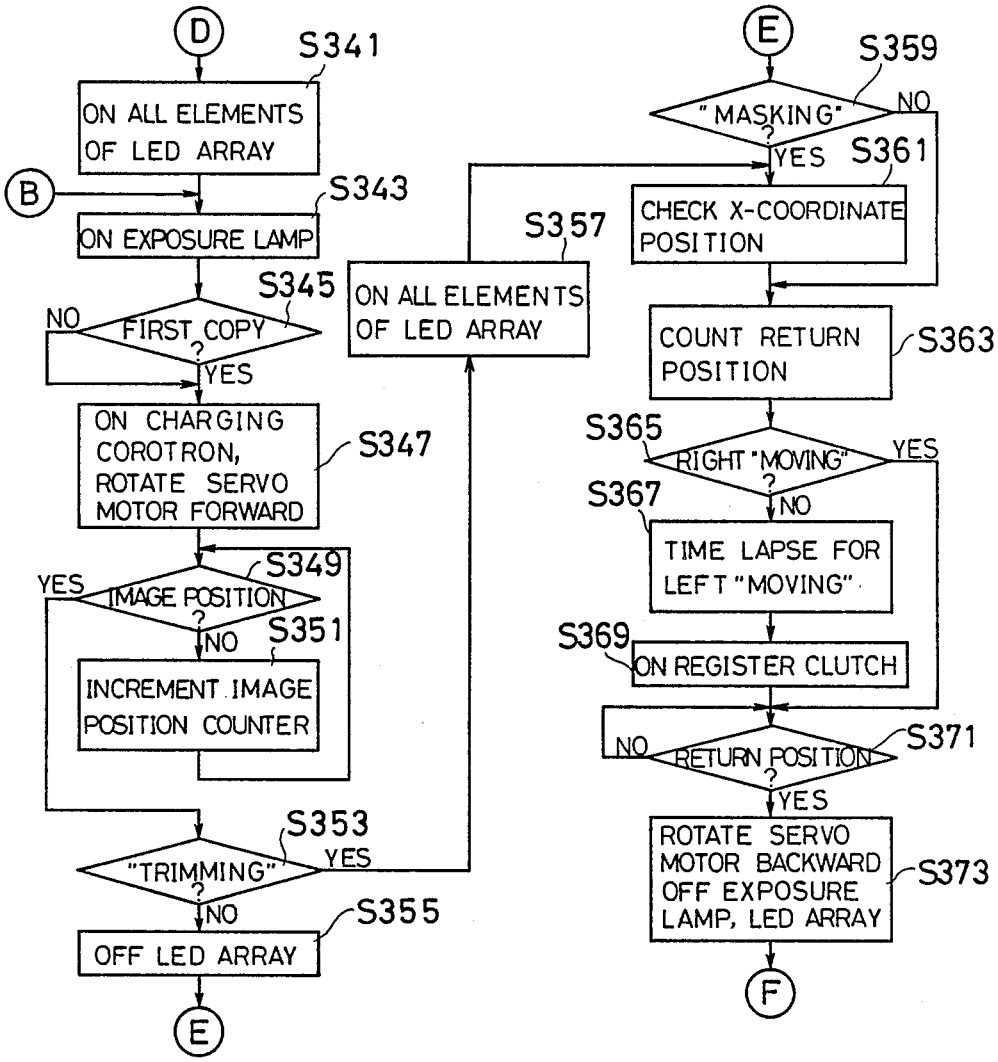
Figure 22C:
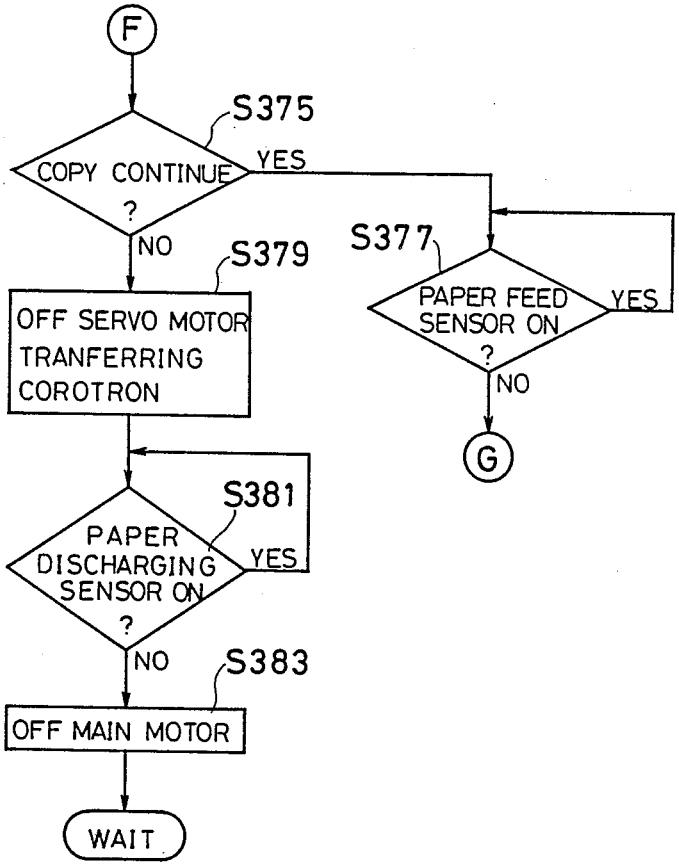

Next, description is made on operations or actions of the copying machine based on flowcharts as shown in FIG. 22A through FIG. 22C in reference to FIG. 19.

On completion of the position designating of the original 18 by using the editor, the operator puts out the IC card 174 from the editor and inserts the same into the IC card insertion portion 176 of the main unit as shown in FIG. 1. Then, the automatic document feeder 26 is opened, and the original 18 is put on the light source 28 so that the original surface is turned downward and the center of the width of the original coincides with the center mark 13*a* formed on the positioning plate 13. Thereafter, the automatic document feeder 26 is closed so that the original is fixedly put on the light source 28. In addition, the original 18 can be set by using the automatic document feeder 26.

Figure 20:
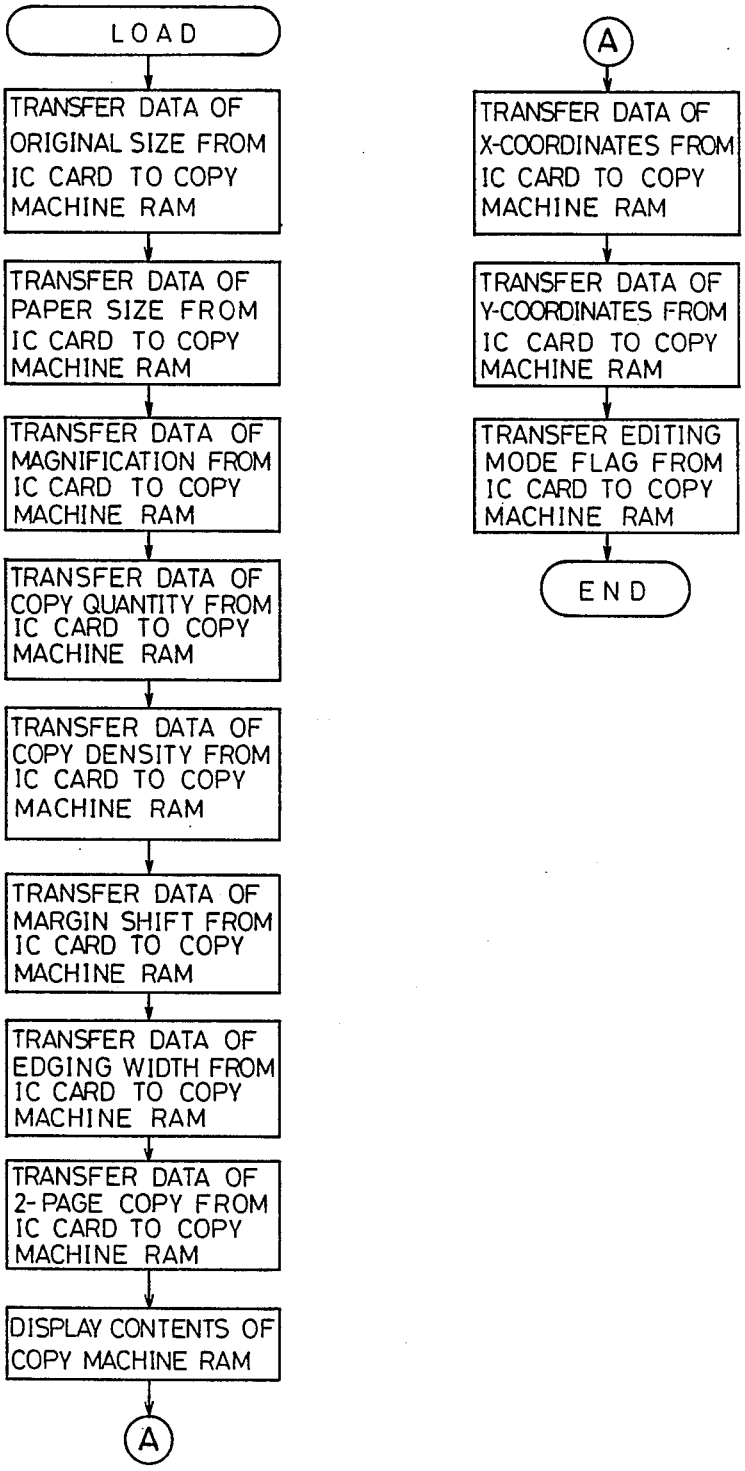
FIG. 20 is a flowchart showing operations when data of the IC card are loaded to the copying machine.
Figure 21:
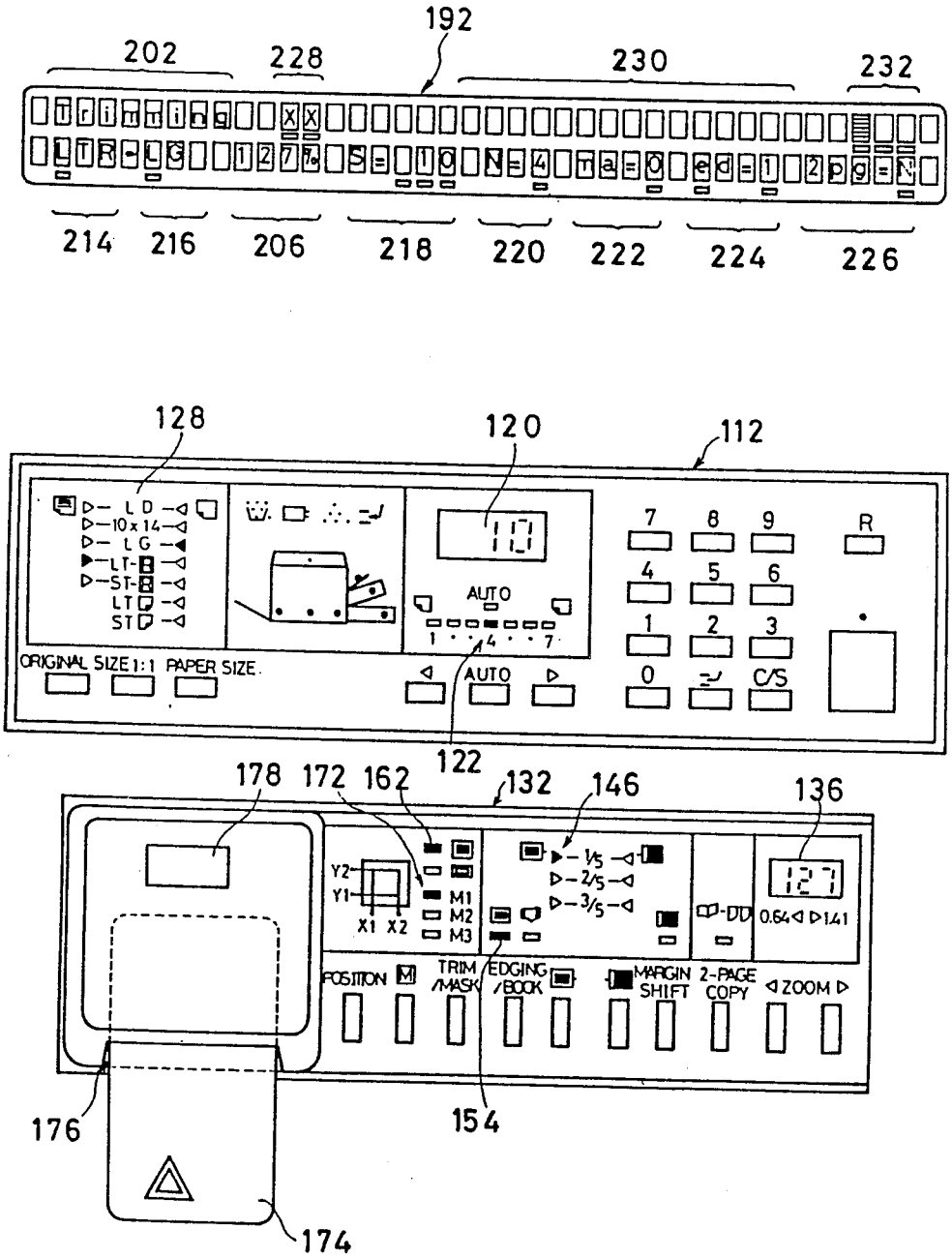
FIG. 21 is an illustrative view showing one example of a displaying of an editor at a timing when an editing condition and a control condition have been set and one example of a displaying of the operating panel corresponding thereto.

If the load key 178 as shown in FIG. 1 is operated, the data stored in the RAM 246 of the IC card 174 are respectively transferred to areas of the RAM 276 respectively corresponding thereto, as shown in a flowchart of FIG. 20. Therefore, prior to an operation of the start key 114, the operator must operate the load key 178 so that the data stored in the IC card 174 such as a editing condition including the positional data and the editing function and control condition including a copy quantity, magnification and so on can be loaded into the RAM 276. Responsively, a displaying of the operating panel 110 of the main unit is automatically changed over as shown in FIG. 21. In FIG. 21, the LEDs to be lightened at that time is shown as a black-painted portion.

In addition, FIG. 21 is a view showing one example of displaying of the LCD 192 of the editor board 180 at the timing when the editing operation has been completed and showing a relationship between the editing condition and the displaying of the operating panel 110 at the timing when the editing condition is loaded to the copying machine main unit 12. Therefore, for example, "127%" displayed on the magnification displaying portion 206 of the LCD 192 is displayed on the numeral display 136 in the operating panel 110. Also, "LTR" and "LD" are respectively displayed on the original size displaying portion 214 and the paper size displaying portion 216 of the LCD 192, but the LEDs of "LTR" and "LD" of the size indicator 128 are lightened when the data is loaded to the copying machine main unit 12. Thus, the displaying of the LCD 192 is converted and displayed on the operating panel 110 of the copying machine main unit 12.

The operator operates the start key 114 after that the copy condition information which includes the editing condition and the control condition of the copying process and being stored in the IC card 174 is thus displayed on the operating panel 110. Responsively, the editing and copying are performed in accordance with the editing condition and the control condition loaded into the RAM 276 of the main unit 12.

In addition, in the copying machine main unit, similar editing and copying are performed by operating the respective keys of the operating panel 110 of the main unit 12 without loading of the IC card 174.

Furthermore, even if the IC card 174 is loaded, it is possible to voluntarily change such a copy condition information by operating keys of the main unit 12.

When the start key 114 is operated, the main motor (not illustrated) for driving the photosensitive drum 38 and so on is turned on in the first step S301 in FIG. 22A. When rotation of the main motor becomes stable, that is, when 0.5 seconds elapses from turn-on of the main motor, a solenoid of the cleaning device 82 is turned on, and the tip part of the blade 84 is brought in contact with the photosensitive drum 38. After a lapse of a predetermined time from turn-on of the solenoid, for example, a lapse of 100 milliseconds for preventing the power source from simultaneous loading, processing proceeds to the next step S303.

In the step S303, the MPU 272 checks for the signal from the sensor 282 (FIG. 17), and determines whether or not the light source 28 is located at the home position, that is, the light source 28 is positioned at the left side of the main unit 12. If the light source 28 is located at the home position, processing proceeds to the next step S307, and if not, in the step S305, a servo motor 288 for moving the light source 28 to the home position is turned on, and the light source 28 is returned to the home position. Turn-off of this servo motor 288 is performed by interrupt processing as described later.

In the step S307, the transferring corotron 62 is turned on. After turning on the transferring corotron 62, processing proceeds to the following step S309. In the step 309, determination is made on whether or not copying is by manual paper feeding, that is, whether or not the copy paper 44 is fed by manual insertion rather than from the paper feed cassette 66 or 74. If copying is by manual insertion, processing proceeds to the next step S311, and the solenoid of the cleaning device 82 turned on in the previous step S301 is turned off. If copying is not by manual insertion, proceeding proceeds to the step S313 without passing through the step S311.

In the next step S313, first a paper feed clutch is turned on, the paper feed roller 72 starts to rotate, and the copy paper 44 is transferred toward the register roller 80. At the same time, the solenoid of the cleaning device 82 is turned off.

In the case of copying by manual insertion in the step S309, that is, in the case of passing through the step S311, the solenoid is turned off twice, but the solenoid has no change at all because only a turn-off signal is supplied. After a lapse of 200 milliseconds from turn-off of the solenoid, processing proceeds to the next step S315. This time of 200 milliseconds is a time for determinating a jam of the copy paper when the copy paper 44 is transferred by turning on the paper feed clutch.

In the step S315, determination is made on whether or not the light source 28 is located at the home position, and if it is located at the home position, processing proceeds to the following step S317.

In the step S317, the MPU 272 determines whether or not right "moving" has been designated by the data loaded from the IC card 174 to the RAM 276. This means that determination is made on whether or not setting has been made so that the image moves to the right by the moving flag and the coordinates data of $X_1$ and $X_2$ of the positions $P_1$ and $P_2$. If setting is made so that the image moves to the right, processing proceeds to the step S319, and if right movement of the image is not set, processing proceeds to the step S343.

In the step S319, determination is made on whether or not the copy is the first one. If the copy is the first one, processing proceeds to the step S321, and if the copy is not the first one, that is, if the copy is the second or the following one, processing proceeds to the step S337.

In the step S321, after a lapse of 300 milliseconds, a servo motor 288 for scanning the light source 28 is turned on. In the next step S323, determination is made on whether or not the light source 28 is positioned at the image position. The image position, that is, the position of the light source 28 for starting to form the image of the original 18 as an electrostatic latent image on the photosensitive drum 38 is determined. If the light source 28 is not reached at the image position, the time from the home position to the image position is counted by a counter in the following step S325.

If the light source 28 comes to the image position, processing proceeds to the next step S327. In the step S327, the servo motor 288 is turned on, and 200 milliseconds after that, the servo motor 288 is rotated in a reverse direction.

Thus, in the case where right movement is set and the copy is the first one, the time taken from the home position to the image position is unknown, and therefore, in the embodiment, this time is actually measured by actually moving the light source 28 before starting copying.

Subsequently, in the step S329, determination is made on whether or not the light source 28 has returned to the home position. When the light source 28 returns to the home position, the process proceeds to the next step S331, and in the step S331, determination is made on whether or not the time taken for moving the image to the right is longer than a sum of the time counted in the previous step S325 and 1020 milliseconds. This 1020 milliseconds liseconds is a sum of 200 milliseconds set in the step S343 as described later, 300 milliseconds after the step S345, 100 milliseconds set in the step S347 and 420 milliseconds set in the step S363. This means that it is required that feeding of the copy paper proceeds forming of the latent image to move the image to the right, and determination is made on whether or not this time of precedence is shorter than the original starting time of paper feeding, that is, the time up to timing of turning on a register clutch in the step S369.

When the time of movement of the image is longer than the sum of the value counted in the previous step S325 and 1020 milliseconds, the register clutch is turned on via the next step S333, and timing adjustment is made in the step S335, and thereafter processing proceeds to the step S341. If "NO" is determined in the step S331, processing proceeds to the step S339, and that time difference is set in a register clutch on-timer (not illustrated) assigned in the RAM. Thus, when the time of movement is shorter than the time of the image position counter plus 1020 milliseconds, that time difference is set in the register clutch on-timer in the RAM 276, and that timer is counted in an interrupt routine as described later. If that timer expires, the register clutch is turned on at that point of time.

On the other hand, if it is determined that the copy is not the first one in the previous step S319, the time (timing) to be measured from the step S321 to the step S331 has been already obtained by the first copy. Accordingly, in the step S337, determination is made on whether or not the time of movement of the image is longer than a sum of the time counted in the step S325 and 720 milliseconds. This 720 milliseconds is a difference 1020 milliseconds in the step S331 and 300 milliseconds required for changing the direction of the light source 28 which is set after the step S345, being the time by which the register roller clutch is to be turned on earlier than the normal timing of paper feeding. When the time of movement is longer than the sum of the time counted in the step S325 and 720 milliseconds in the step S337, processing proceeds to the step S333, and if shorter, processing proceeds to the following step S339. Accordingly, when "NO" is determined in the step S337, that is, when the time of movement is shorter, timing thereafter is to be determined in the interrupt routine likewise the case of "NO" in the previous step S331.

In the step S341 (FIG. 22B), the LED array 46 is turned on so that all the LED elements 50 are lightened. This means that the MPU 272 gives a signal for "full lightening" to the LED array 46. When the image is to be moved to the right, the LED array 46 is fully lightened here to prevent an image at the left side of the original 18, for example, an image of the positioning plate 13 from being formed on the photosensitive drum 38, that is, to erase a useless electrostatic latent image.

Thereafter, in the step S343, the light source 28 for irradiating (exposing) light onto the original 18 is turned on, and because of a slow rise of the light source 28, the process proceeds to the following step S345 after a lapse of 200 milliseconds. In step S345, determination is made on whether or not the copy is the first one likewise the previous step S319. If the copy is the first one, because of a slow rise of the light source 28 turned on in the previous step S343, processing proceeds to the step S347 after a further lapse of 300 milliseconds required for stabilization.

In the step S347, the charging corotron 48 is turned on, and at the same time, the servo motor 288 is turned on.

In the following step S349, determination is made on whether or not the light source 28 has been fed to the image position. If it does not reach the image position, the time taken from the home position to the image position is counted in the next step S351. However, in the case of the first copy, the time taken from the home position to the image position in the previous step S325, and therefore the data measured in the step S351 is ignored and not utilized. In only the case of continuous copying, the data counted in this step S351 is used as image position data for right movement of the image. If it is determined that the light source 28 has reached the image position in the step S349, processing proceeds to the following step S353.

In the step S353, the MPU 272 checks for the data of the RAM 276 given from the IC card 174, and determines whether or not "trimming" is set. If it is determined that "trimming" is not set in the step S353, the LED array 46 turned on in the previous step S341 are turned off or put out. If it is determined that "trimming" is set, processing proceeds to the step S357, while turn-on or full lightening of the LED array 46 is kept intact.

In the step S359, the MPU 272 checks for the data of the RAM 276, and determines whether or not "masking" is set. If it is decided that "masking" is set, processing proceeds to the next step S361.

In the step S361, the position of X ordinate of the points $P_1$, $P_3$, $P_2$ and $P_4$ for "trimming" or "masking" set by the data transferred to the RAM 276 from the IC card 174 are checked. Specifically, start of the X ordinate detection is determined in the above-described interrupt routine, and thereafter detection is made in that interrupt routine. Then, in the step S363, the time up to the completion of feeding of the light source 28 is counted. Thereafter, processing proceeds to the next step S365 after a lapse of 420 milliseconds equivalent to the timing of paper feeding in the normal case.

In the step S365, likewise the previous step S317, determination is made on whether or not the "moving" in which the image is to be moved to the right is set. If right movement is set, since the register roller 80 is already driven by turning on the register clutch in the previous step S333, driving of the register roller 80 is detected, and the process proceeds to the step S371.

If it is determined that right movement of the image is not set, that is, when the image is to be moved to the left in the "moving", the time taken for left moving is counted in the next step S367, and thereafter the register clutch is turned on.

When it is detected that the light source 28 has been fed to the return position in the step S371, the process proceeds to the next step S373, and the servo motor 288 is turned on and the exposure light source 28 is turned off, and then the LED array 46 being turned on in the previous step S341 is put out in step S373.

In the step S375 (FIG. 22C) thereafter, the MPU 272 checks for a copy quantity counter, and determines whether or not copying is to be continued. If copying is to be continued, a paper feed sensor is turned off in the next step S377, and thereafter processing returns to the previous step S313. This means that processing of and after the second copy is started in this step S313.

If it is determined that copying is not to be continued in the step S375, processing proceeds to step S379, and the servo motor 288 being turned on in the previous step S373 is turned off. Thereafter, the charging corotron 48 is turned off after a lapse of the time of transfer of the electrostatic latent image on the photosensitive drum 38 onto the copy paper 44, for example, 200 milliseconds. Then, the process proceeds to the step S381. In the step S381, turn-on of a paper discharge sensor by a discharge of the copy paper 44 is detected, and the process proceeds to the next step S383. In the step S383, the main motor is turned off after a lapse of 200 milliseconds required for discharging the copy paper 44. Then the copying machine is put in the ready state.

Figure 23A:
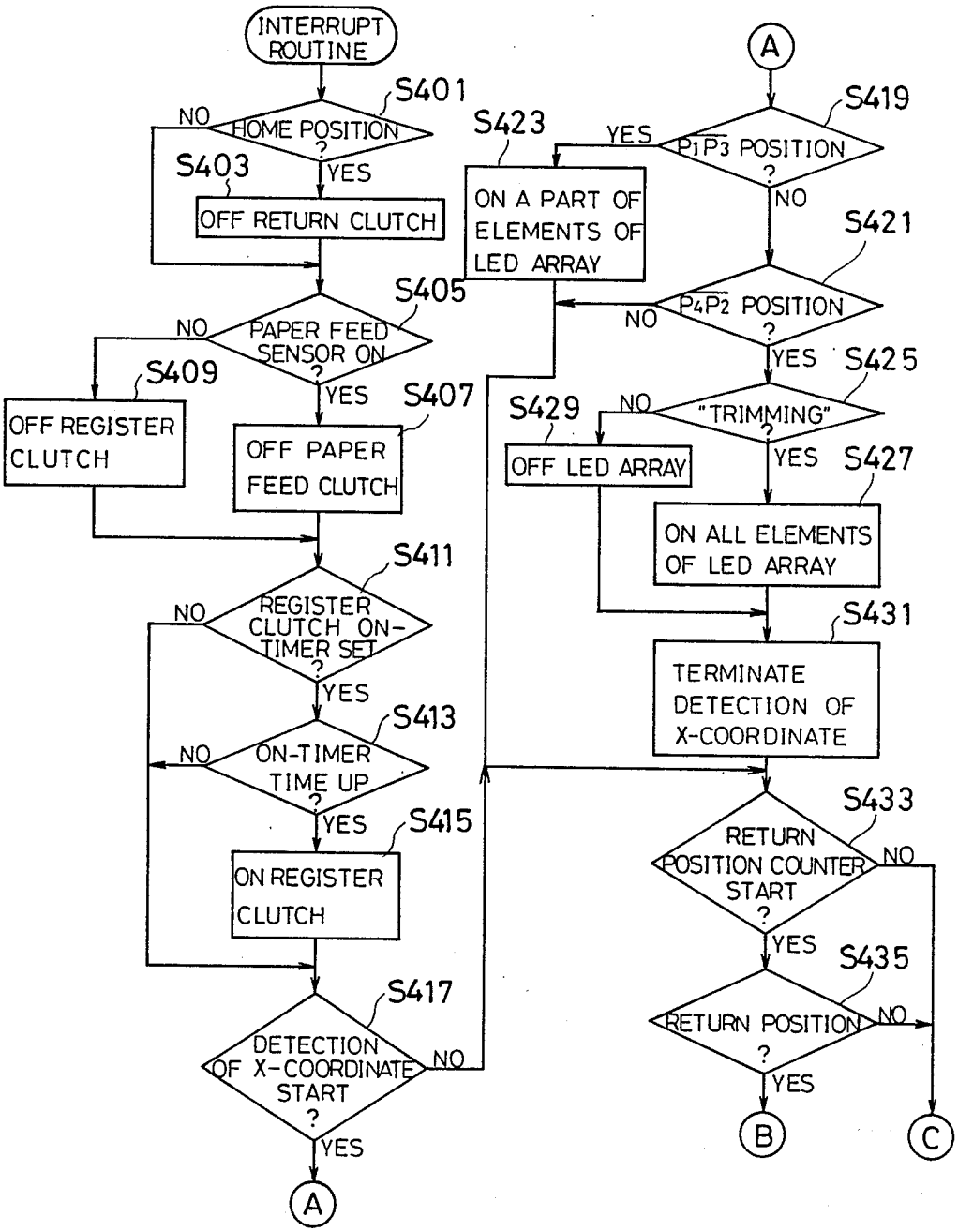
FIG. 23A and FIG. 23B are flowcharts showing an interrupt routine of the embodiment.
Figure 23B:
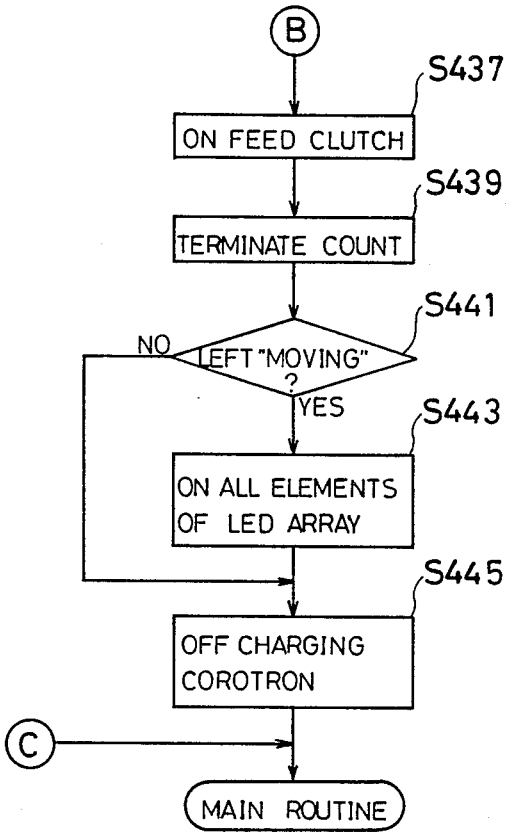

Next, description is made on an interrupt routine of this embodiment in reference to FIG. 23A and FIG. 23B. This interrupt routine is called at constant periods by an inner timer of the MPU 272. The interrupt routine mainly determines the timing of turn-on of the register clutch in the "moving" mode, and also controls the position and timing of lightening of the LED array 46 in the "trimming" or the "masking" mode.

In the first step S401, the MPU 272 determines whether or not the light source 28 is located at the home position likewise the step S303 in the previous FIG. 22A. If it is not located at the home position, the process proceeds intact to step S405, but if located at the home position, the servo motor 288 is turned off in the step 403 and thereafter the process proceeds to step S405.

In the step S405, determination is made on whether or not the paper feed sensor is turned on, that is, whether or not the copy paper 44 has been transferred to the register roller 80. Then, when the transfer of the copy paper 44 is made sure, the paper feed clutch is turned off in the step S407. Thereafter, processing proceeds to the step S411. If the preceding copy paper has been transferred, the paper feed sensor is turned off, and therefore the MPU 272 turns off the register clutch in the following step S409 thereafter the process proceeds to the step S411.

In the step S411, when right movement of the image is set by the data from the IC card 174, determination is made on whether or not the time difference between the time of movement and the timing of start of the electrostatic latent image has been set in a register clutch on-timer assigned in the RAM in the step S339. If "YES" is determined in the step S411, the MPU 272 determines whether or not this on-timer has expired in the following step S413. Then, when the register clutch on-timer expires through several times of executions of this interrupt routine, the MPU 272 turns on the register clutch in the step S415. This means that at this point of time, the timing of paper feeding for right movement of the image is determined.

In the next step S417, the MPU 272 determines whether or not "trimming" or "masking" is set and detection of the X ordinate for controlling the LED array 46 has been started. This can be determined, for example, by setting a flag in the step S361 (FIG. 22B) and detecting by the MPU 272 whether or not that flag is set.

When start of the X ordinate detection is determined, the MPU 272 determines whether or not one side defined by the straight line $P_1P_3$ of the area to be trimmed or masked (designated by the points $P_1$, $P_3$, $P_2$ and $P_4$) has reached just under the partial erasure lamp, that is, the LED array 46. Then, when the area to be trimmed or masked reaches the LED array 46, the MPU 272 gives signals to the LED array 46 so as to lighten all the LED elements 50 outside that area in the "trimming" and lighten all the LED elements 50 in that area in the "masking". Thereby, the LED elements 50 of the LED array 46 required for "trimming" or "masking" are partially and selectively lightened in the step S423.

If "NO" is determined in the step S419, the MPU 272 determines whether or not one side defined by the straight line $P_4P_2$ of the area to be trimmed or masked has reached just under the LED array 46 in the following step S421. Then, if this is detected in step S421, the process proceeds to the next step S425.

In the step S425, the MPU 272 determines whether "trimming" or "masking" is set. If "trimming" is set, thereafter all the LED elements 50 of the LED array 46 are lightened in the step S427. In reverse, if "masking" is set, all the LED elements 50 of the LED array 46 partially lightened in the step S423 are put out. After execution of the step S427 or the step S429, the MPU 272 completes detection of the X ordinate.

Thereafter, in the step S433, the MPU 272 determines whether or not count of the position whereto the light source 28 is to be returned which is started in the previous step S363 has been started. Then, in the step S435, the time required for feeding the light source 28 by the length of the original in the direction of movement of the light source 28 (including a margin) is counted, and determination is made on whether or not the light source 28 has reached the position whereto it is to be returned. Then, if "YES" is determined in the step S435, the MPU 272 turns off the servo motor 288 in the next step S437, and completes the count of the feeding position in the next step S439.

In the step S441 thereafter, the MPU 272 determines whether or not the left "moving" is set based on the data in the RAM 276. If left movement is set, the LED array 46 is fully lightened to erase the electrostatic latent image not required for that left movement in the next step S443, and the charging corotoron 48 (FIG. 2) is turned off in the step S445 to prevent charging onto the photosensitive drum 38 thereafter. After the step S445 has been executed, the process returns to the main routine as shown in FIG. 22A, FIG. 22B and FIG. 22C likewise the case where "NO" is decided in the previous steps S133 and S135 respectively.

Thus, in accordance with the above-described embodiment, in "trimming" or "masking", the area or range of lightening of the LED array 46 (partial erasure lamp) is controlled corresponding to the area defined by the four (4) points $P_1$, $P_2$, $P_3$ and $P_4$ which are set by the data transferred from the IC card 174 to the RAM 276. Also, when "moving" is set the MPU 272 controls the image position and a deviation of a paper feed timing in accordance with the amount based on the positional data inputted from the data in the RAM 276

Figure 24:
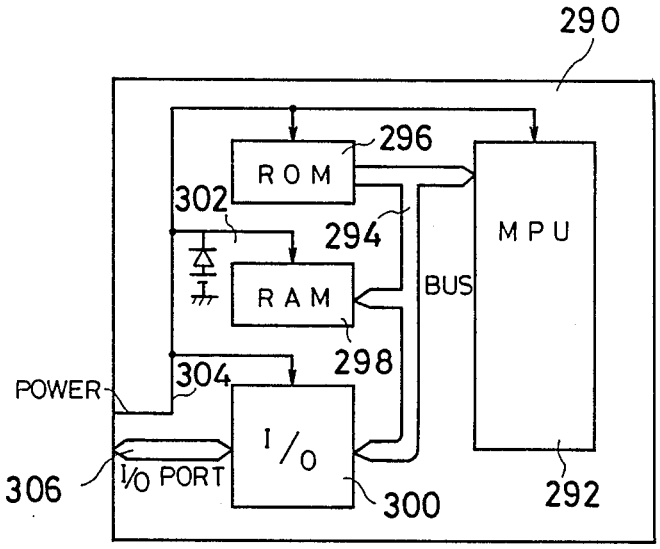
FIG. 24 is a block diagram showing another example of an IC card.

In addition, instead of the IC card 174, a further IC card 290 as shown in FIG. 24 may be used. The IC card 290 incorporates an MPU or CPU therein and, called as a "micon card". In detail, the IC card 290 is controlled by a microcomputer system including a microprocessor (MPU 292). The microcomputer system includes, other than the MPU 292, a ROM 296 connected to the MPU 292 by a bus 294 and for storing a control program, a RAM 298 for temporarily storing data in controlling by the MPU 292 and having a various flag areas necessary for controlling, and an I/O interface 300 for making the MPU 292 to output control signals to the tablet circuit 184 and the LCD 192 (FIG. 4). In addition, a power source is normally applied to the IC card 290 by a power line 304; however, like the previous example, the IC card 290 may be backed up by the lithium battery 302. Further, the I/O interface 300 is connected to an input/output port 306 of the IC card 290.

By using such a micon card 290, control portions is wholly included in the card 290 except for external circuits of the LCD 192 and the tablet 184 of the editor board 180, therefore, it is possible to omit the microcomputer in the editor board 180. Furthermore, it is possible to make the card 190 to take charge of a whole or a part of the microcomputer system of the copying machine main unit.

Figure 25:
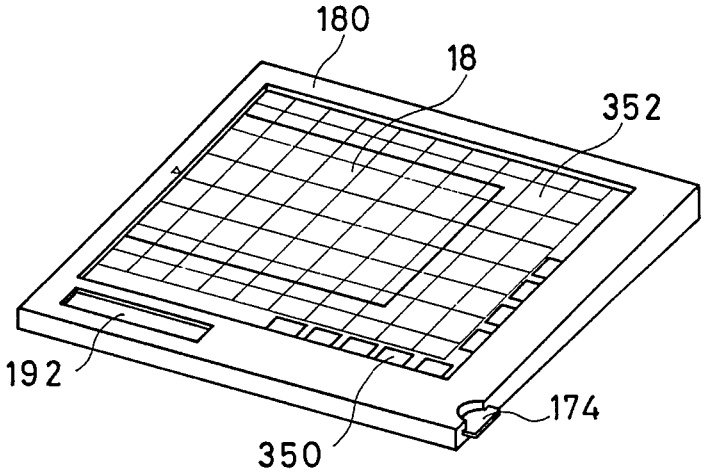
FIG. 25 is a perspective view showing another example of an editor which can be used in the embodiment.
Figure 26:
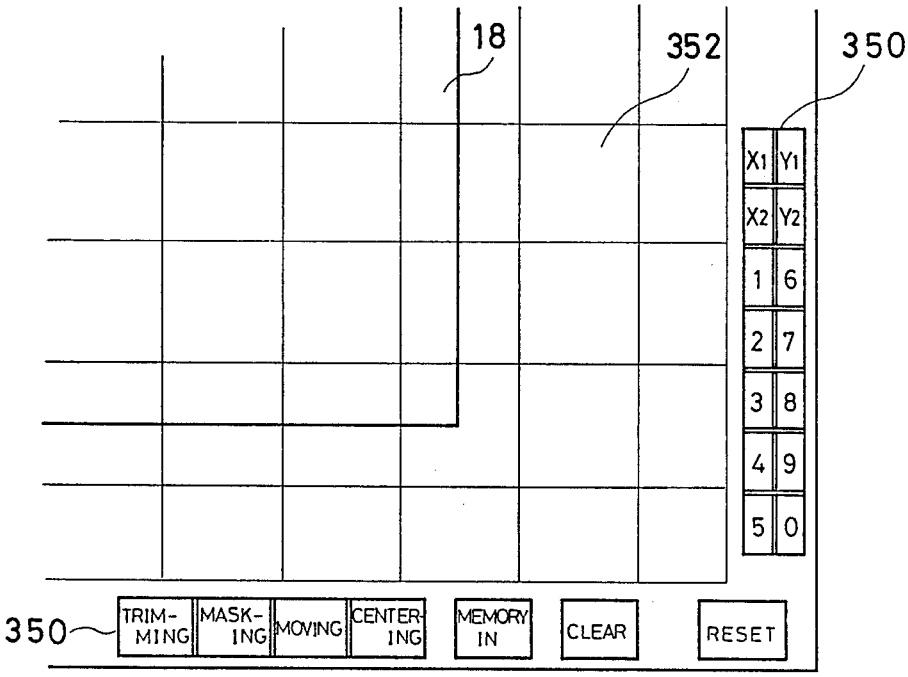
FIG. 26 is an illustrative view showing a major portion of FIG. 25.

FIG. 25 is a perspective view showing another example of the editor which can be used in the embodiment. In this embodiment shown, operating keys 350 provided on the tablet are utilized as input means. More specifically, on the editor board 180, a plurality of operating keys 350 are provided, some of which function as editing condition setting keys and the others function as keys for setting control condition for controlling copying process.

Specifically, when the editing operation should be performed, first, the key corresponding to a desired editing function such as "trimming", "masking", "moving" or "centering" is depressed. For example, if the key for "Trimming" is operated, "trimming" is displayed on the LCD 192. Next, the original 18 is put on the tablet 184 so as to be turned upward and coordinates sheet 352 is put thereon. Then, the coordinates positions on the original surface of the original 18 to be edited (for example as shown in FIG. 12A through FIG. 14B) are decided. In order to input the coordinates, an $X_1$ key is operated. Then, data of the coordinates $X_1$ is inputted by using a ten key. Accordingly, a message is displayed on the LCD 192 to indicate that the coordinates data $X_1$ is received. Likewise, the coordinates $Y_1$, $X_2$ and $Y_2$ may be inputted and set. If key input is completed, then, a memory in key is depressed. Responsively, the data necessary for editing is stored into the IC card 174 (or 290). Such a data controls image forming operation of the copying machine main unit.

In addition, in this embodiment, an operating key 350 which acts as an editing function key is illustrated but, of course, there are provided a group of operating keys having functions similar to that of FIG. 5. Also, in FIG. 25, a detail of the liquid crystal display cannot be apparent, but it is not necessary to say that the same has functions similar to the LCD 192 as shown FIG. 6.

Figure 27:
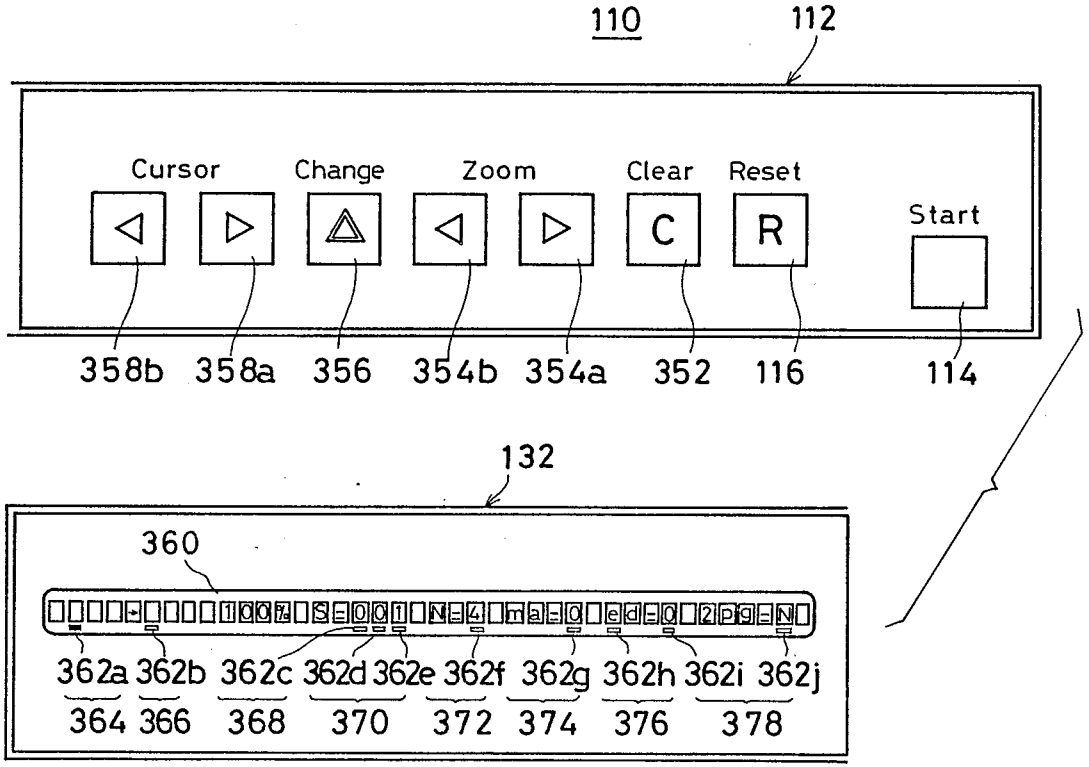
FIG. 27 is an illustrative view showing a right panel of an operating panel of another embodiment in accordance with the present invention.

Next, a description is made on another embodiment in accordance with the present invention with reference to FIG. 27. In this embodiment, the above described input device is embodied to an electrophotographic copying machine.

An operating panel 110 is provided on an upper surface of this side of the main unit of the electrophotographic copying machine. As shown in FIG. 27, a right panel of the panel 110, that is, an operating panel 112, a start key 114 for commanding to start of a copying process is provided at the right end thereof. At the left side of the start key 114, a reset key 116 for releasing all of the image forming condition set by means of key operations of the operating panel 112.

At the left side of the reset key 116, there is provided a clear key 352 for partially releasing image forming condition set by means of key operations. In addition, the item which is cleared by operating the clear key 352 is determined by a position of cursor described lately. For example, in the case where the set copy quantity is five (5), if the clear key 352 is operated at a time when the cursor is positioned to the item displaying portion of the copy quantity, the set copy quantity is cleared and set as "1". If another image forming condition, for example, a copy density is set and thereafter the cursor is positioned at that position and the clear key 352 is operated, as described lately, the set copy density is cleared and a standard copy density is set.

At the left side of the clear key, there are provided zoom keys **354*a* and 354*b* for setting a copy magnification. The zoom key 354*a* is operated to zoom up the copy magnification and the zoom key 354*b* is operated to zoom down the copy magnification. Therefore, if the copy magnification larger than the desired copy magnification is set by mistake by operating the zoom key 354*a*, the copy magnification can be returned to the desired copy magnification by operating the zoom key 354*b*. In addition, the zoom keys 354*a* and 354*b* effectively act only when the original size were not set because if the original size and the paper size are both set a copy magnification is automatically decided. Therefore, at that time, an input of the copy magnification is inhibited even if the zoom key 354*a* or 354*b*** is operated.

At the left side of the zoom key **354*b*, there are provided a change key 356 and cursor keys 358*a* and 358*b*. An item of the image forming condition other than the copy magnification which can be directly set by the zoom keys 354*a* and 354*b* can be set by operating the cursor keys 358*a* and 358*b* and the change key 356**.

The cursor key **358*a* is a key for moving the cursor to be lightened in a cursor displaying portion described lately toward right and the cursor key 358*b* is a key for moving the cursor to be lightened toward left. More specifically, the cursor to be lightened is selected by operating the cursor key 358***a* or 358*b* and the item corresponding to the selected cursor is changed by operating the change key 356. For example, after the cursor corresponding to the item displaying portion which displays a copy density is lightened, if the change key 356 is operated, the copy density is changed and set in accordance with the number of times of operations of the change key.

In a left panel of the panel 110, that is, a display panel 132, a liquid crystal display (LCD) 360 having a rectangular shape and extending approximately a whole length of the display panel 132 is formed. Under the LCD 360, there are provided cursor indicators 362*a*–362*j*. The cursor indicator to be lightened in the cursor indicators 362*a*–362*j* is selected by the aforementioned cursor key 358*a* or 358*b*. More specifically, when the cursor key 358*a* is operated, the cursor indicator to be lightened is sequentially moved toward right in accordance with the number of times of operations of the cursor key 358*a*. In reverse, if the cursor key 358*b* is operated, the cursor indicator to be lightened is sequentially moved toward left in accordance with the number of times of operations of the cursor key 358*b*. The cursor key 358*a* is operated when the cursor indicator 362*j* is lightened, then the cursor indicator 362*a* is lightened. Also, when the cursor key 358*b* is operated in the state that the cursor indicator being lightened is 362*a*, the cursor indicator 362*j* is lightened.

The LCD 360 includes item displaying portions 364–378. The contents of displaying shown FIG. 27 of the item displaying portions 364–378 of the LCD 360 show the contents of displaying just after the electric power source of the electrophotographic copying machine 10 is turned on, that is, in the initial state. Therefore, a new image forming condition is inputted by operating the change key 356 after the cursor indicator of the item displaying portion corresponding thereto being lightened by the cursor key 358*a* or 358*b*. In addition, in the initial state, the cursor indicator 362*a* is lightened.

An original size displaying portion 364 displays a designated original size by utilizing five (5) kinds of symbols as shown in FIG. 28. In the initial state, the cursor indicator 362*a* is lightened and the original size displaying portion 364 does not display anything as shown in FIG. 27. Then, if the change key 356 is operated once, "LD" is displayed on the original size displaying portion 364 and thus the original size is designated. In the state that "LD" is displayed, if the change key 356 is operated by three times, a displaying of the original size displaying portion 364 is changed to "LTR" as shown in FIG. 28. Thus, designation of the original size is made by operating the change key 356 after lightening the cursor indicator 362*a*. In addition, when the cursor indicator 362*a* is not lightened, that is, in a state other than the initial state, the cursor indicator 362*a* is lightened by operating the cursor key 358*a* or 358*b*.

A paper size displaying portion 366 displays a size of a selected paper by utilizing symbols of seven (7) kinds as shown in FIG. 28. Since in this electrophotographic copying machine two paper feeding cassettes can be simultaneously loaded thereto, it is necessary to select which cassette is to be used. Likewise designation of the original size, selection of the paper feeding cassettes, that is, designation of the paper size is made by operating the change key 356 after lightening the cursor indicator 362*b* by the cursor key 358*a* or 358*b*. In addition, in this embodiment, in the initial state shown in FIG. 27 the paper size displaying portion 366 does not display anything. However, since only two paper feeding cassettes can be simultaneously loaded, it is possible to make modification such that a size of paper accommodated in any one of the paper feeding cassettes is displayed on the paper size displaying portion 366 and the designation of the paper size is changed by operating once the change key 356 after lightening the cursor indicator 362*b*. Then, in designating the paper size, the number of times of operations of the change key 356 can be decreased.

Magnification displaying portion 368 displays a copy magnification. In the initial state, "100%" is displayed as shown in FIG. 27. A copy magnification capable of being set by the zoom key 354*a* or 354*b* is in the range of 64%–141%. In addition, when both of the original size and the paper size are designated, for example, the original size is designated as "LTR" and the paper size is designated as "LG", "127%" is displayed even if the zoom key 354*a* or 354*b* is not operated. This means that as described above, a copy magnification can be set by the zoom key 354*a* or 354*b* only when the original size is not designated.

A copy quantity displaying portion 370 displays a set copy quantity. In this copying machine, copy quantity is in the range one sheet to 999 sheets. In the initial state, "S=001" is displayed on the copy quantity displaying portion 370 as shown in FIG. 27. A digit of hundreds is set by inputting a desired numeral value out of "0–9" by operating the change key 356 after lightening the cursor indicator 362*c* by operating the cursor key 358*a* or 358*b*. Likewise, setting of a digit of tens and a digit of units can be made by operating the change key 356 after the cursor indicators 362*a* and 362*e*, respectively.

A density displaying portion 372 displays which one of seven notches of copy density is designated. Setting of the copy density is made by operating the change key 356 after lightening the cursor indicator 362*f*. In the initial state, "N=4" which is a standard density is displayed on the density displaying portion 372.

A margin displaying portion 374 displays a width of a margin for forming a blank at the left end of the paper for a binding margin. Therefore, in the normal copy, since it is not necessary to form the binding margin or blank a copying process is executed in the initial state in that "ma=0" is displayed on the margin displaying portion 374. A width of the blank capable of being set is three notches in this embodiment. When the margin is to be set, shift amount is set by operating the change key 356 after lightening the cursor indicator 362*g*. Then, the set width of the blank, that is, the sift amount is displayed on the item displaying portion just above the cursor indicator 362*g* by the numeral value "1, 2 or 3".

An edging/book displaying portion 376 displays a width of a margin in edging mode or book mode. Selection of the edging mode or book mode is made by operating the change key 356 after lightening the cursor indicator 362*h* by the cursor key 358*a* or 358*b*. When the edging mode is selected, "ed=0" is displayed on the edging/book displaying portion 376 as shown in FIG. 27. This means that when the edging mode is selected, the width of the margin should be also set. When the numeral value just above the cursor indicator 362*i* is "0", the edging mode is not set and the normal copy is executed even if the edging mode is selected. In selecting the edging mode, in order to set the width of the margin, the cursor key 358*a* is operated so as to lighten the cursor indicator 362*i*. Thereafter, when the change key 356 is operated once, "1" is displayed in the portion just above the cursor indicator 362*i* as shown in FIG. 28. In addition, the width of the margin capable of being set is three notches in this embodiment.

After lightening the cursor indicator 362*h*, when the edging mode is not selected by the change key 356, that is, the book mode is selected, "book" is displayed on the edging/book displaying portion 376. At this time, the change key 356 does not effectively act even if the same is operated after lightening the cursor indicator 362*i*. More specifically, in this embodiment, if the book mode is selected, a portion of the binding margin of the opened book is blanked and the width of that portion is constant. Therefore, it is not necessary to operate the change key 356 when the book mode is selected.

A 2-page copy displaying portion 378 displays whether the left page and the right page of the opened book should be respectively copied onto two sheets of papers or not when the book original is to be copied, for example. Since in the initial state the 2-page copy displaying portion 378 becomes "2pg=N" as shown in FIG. 27, if 2-page copy should be made, the cursor indicator 362*j* is lightened and thereafter making to display "Y" just above the cursor indicator 362*j* by operating the change key 356.

Figure 29:
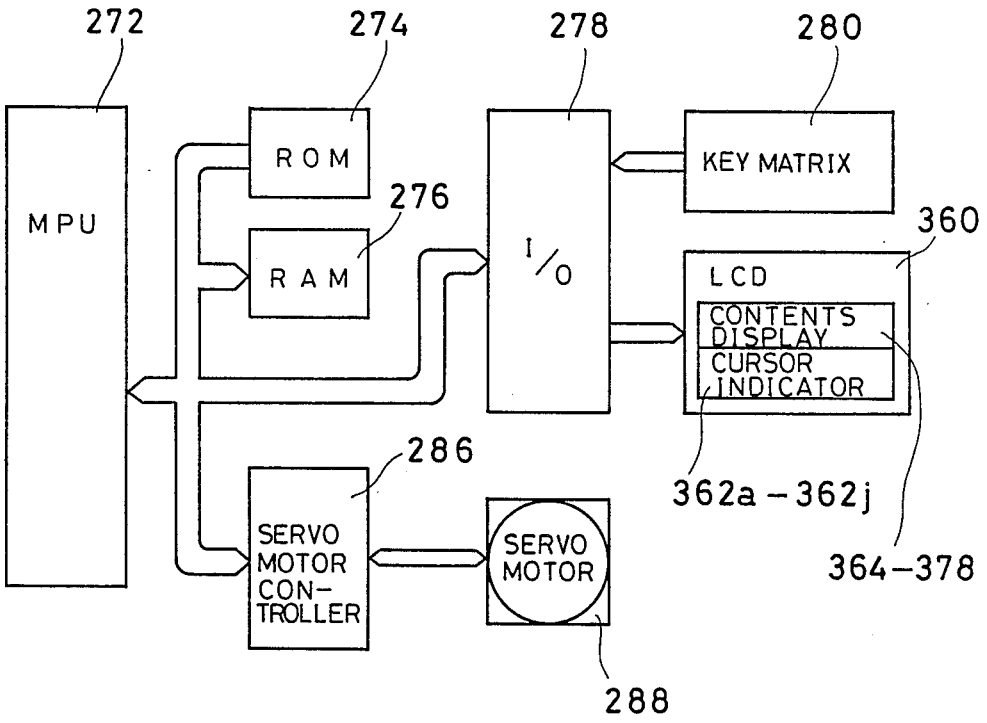
FIG. 29 is block diagram of the embodiment.

FIG. 29 is a block diagram of a control portion of the copying machine main unit of the embodidment. FIG. 29 is similar to the block diagram of FIG. 19 except for that the cursor indicators 362*a*–362*j* and item displaying portions 364–378 are illustrated in the LCD 192, and therefore duplicate description is omitted here.

Next, description is made on operations or actions of the embodiment based on flowcharts as shown in FIG. 30A through FIG. 30D with reference to FIG. 29.

The operation of the operating keys 116 through 358*b* are controlled by an interrupting process of the MPU 272.

Figure 30A:
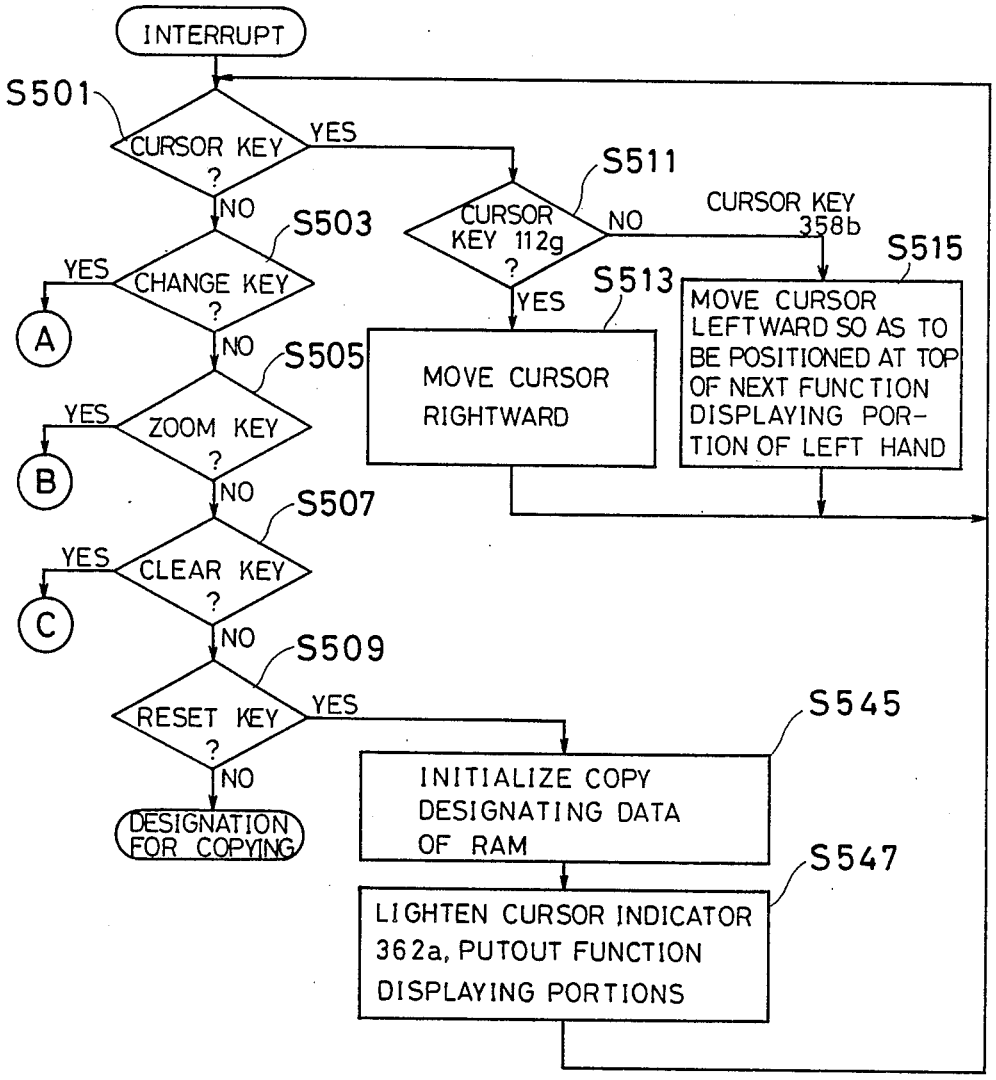
FIG. 30A through 30D are a flowchart showing an operation or actions of the embodiment.

In FIG. 30A, it is determined whether or not any of key out of the operating keys 116–358*b* are operated in the steps S501–509.

If it is determined that the cursor key 358*a* or 358*b* is operated in the step S501, the process proceeds to the step S511.

In the step S511, it is determined whether or not the operated key is the cursor key 358*a*. If determined by the MPU 272 that the operated key is the cursor key 358*a*, the process proceeds to the step S513 and, if determined that the operated key is not the cursor key 358*a*, that is, when the cursor key 358*b* is operated the process proceeds to the step S515. In the step S513, a position to be lightened of the cursor indicators 362*a*–362*j* as shown in FIG. 27 is sequentially moved toward right as a function of the number of times of operations of the cursor key 358*a*. In reverse, in the step S515, a position to be lightened of the cursor indicators 362*a*–362*j* is sequentially moved toward left as a function of the number of times of operations of the cursor key 358*b*.

Figure 30B:
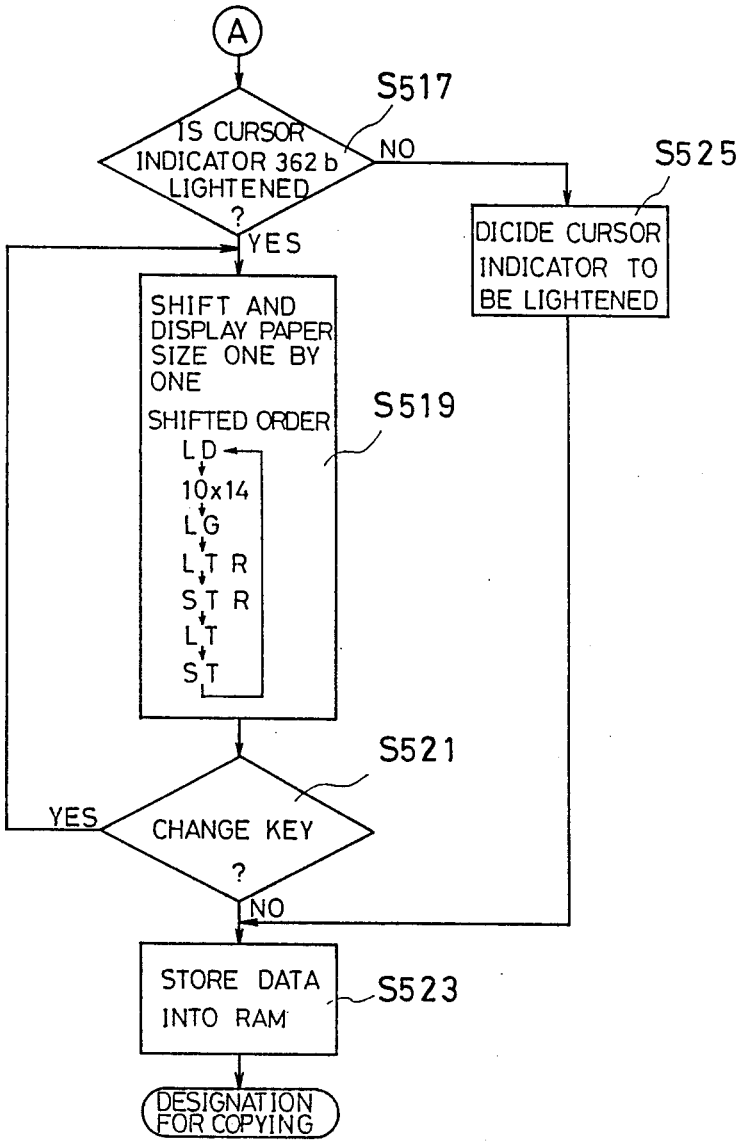

In the step S503, determination is made on whether or not the change key 356 is operated after designating of the cursor indicator to be lightened by the cursor keys 358*a* and 358*b*. If the cursor indicator 362*b* is lightened in the step S503, next, the process proceeds to the step S519 as shown in FIG. 30B. In the step S519, the selected size of the paper is displayed on the paper displaying portion 366 of the LCD 360.

In the next step S521, it is determined by the MPU 272 whether or not the change key 356 is further operated. Upon confirmation of the operation, the process returns to the previous step S519. Then, in the step S519, responsibly, a displaying of the paper size displaying portion 366 is shifted. In addition, since the LCD 360 shown in FIG. 27 is in the initial state the paper size displaying portion 366 does not display anything, but "LG", for example, is displayed on the paper size displaying portion 366 when the paper size is designated.

In the case where the change key 356 is not operated in the step S521, in the step S523, the data of the paper size displayed and selected in the step S519 is stored in the RAM 276.

In the case where the cursor indicator 362*b* is not lightened in the first step S501, the process proceeds to the step S525 from the step S517 of FIG. 30B.

In the step S525, a position to be lightened of the cursor indicators 362*a*–362*j* is decided in accordance with the number of times of operation of the cursor key 358*a* or 358*b*. Then, data corresponding to the decided cursor indicator is also stored in the RAM 276 in the next step S523.

Figure 30C:
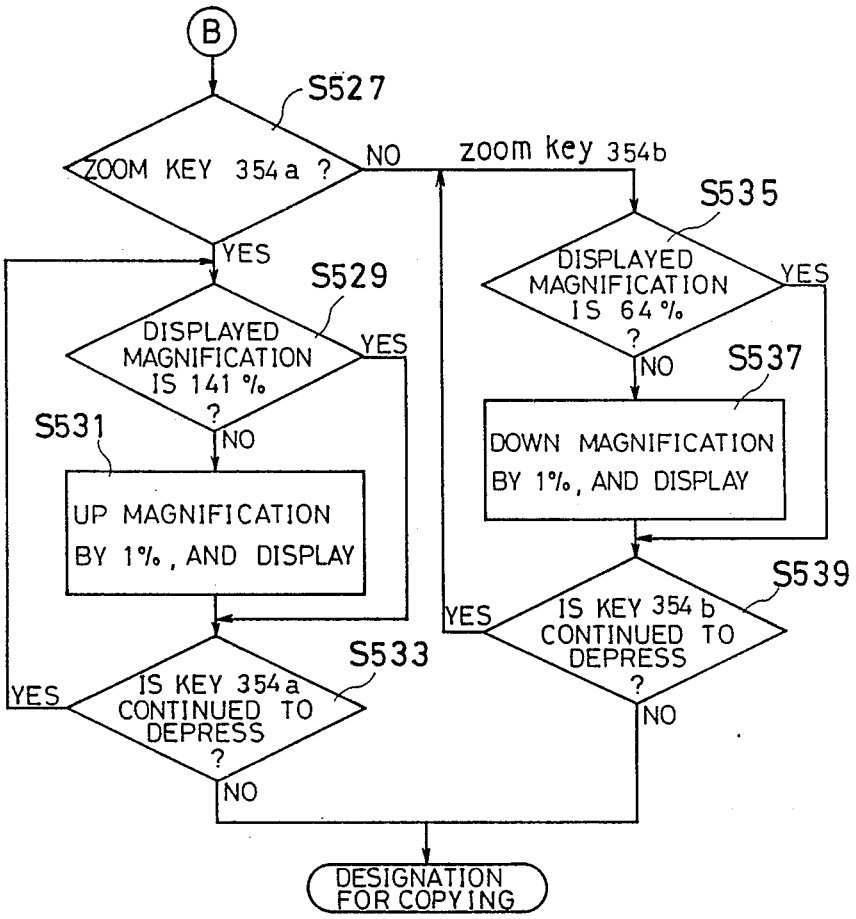

In the case where that the zoom key 354*a* or 354*b* is operated in the step S505, next, the process proceeds to the step S527 as shown in FIG. 30C. In the step S527, it is determined whether or not the operated zoom key is 354*a*. If zoom key 354*a*, the process proceeds to the step S529.

In the step S529, it is determined whether or not the copy magnification is the upper limit of the enlargement in the copy machine main unit 12, that is, 141%, for example. If the magnification displayed on the magnification displaying portion 368 is 141%, the process proceeds to the S533. If the magnification displayed on the magnification displaying portion 368 is smaller than 141%, that is, in the case where the copy magnification is able to be changed larger, the process proceeds to the step S533 through the step S531. In the step S531, 1% is added to the magnification presently displayed on the magnification displaying portion 368, and being displayed. In the step S533, it is determined whether or not the zoom key 354*a* continues to be depressed. If continues, the process returns to the step S529 and repeats the step S529 through the step S533. Accordingly, if it is confirmed that the maximum enlargement magnification, i.e. 141% has been set, no change occurs in the magnification displaying portion 368 even if the zoom key 354*a* continues to be depressed in the step S533 and, a setting of the enlargement magnification larger than that is prohibited.

In the case where the operated zoom key is not 354*a* in the step S527, that is, in the case where the operated zoom key is 354*b*, the process proceeds to the step S535. In the step S535, it is determined whether or not the magnification displayed on the magnification displaying portion 368 is the lower limit of the reduction magnification, that is, 64%, for example. If the magnification is 64% presently displayed on the magnification displaying portion 368, the process proceeds to the step S539 from the step S535.

In the case where the magnification displayed on the magnification displaying portion 368 is larger than 64%, that is, in the case where the magnification is able to be set further reduction, the process proceeds to the step S539 through the step S537. In the step S537, 1% is subtracted from the magnification presently displayed on the magnification displaying portion 368, and being displayed.

In the next step S539, it is determined whether or not the zoom key 354*b* continues to be depressed. If continues, the process returns to the step S535 and repeats the step S535 through the step S539. Accordingly, if it is confirmed that the minimum reduction magnification, i.e. 64% has been set, no change occurs in the magnification displaying portion 368 even if the zoom key 354*b* continues to be depressed in the step S539 and, a setting of the reduction magnification smaller than that is prohibited.

Figure 30D:
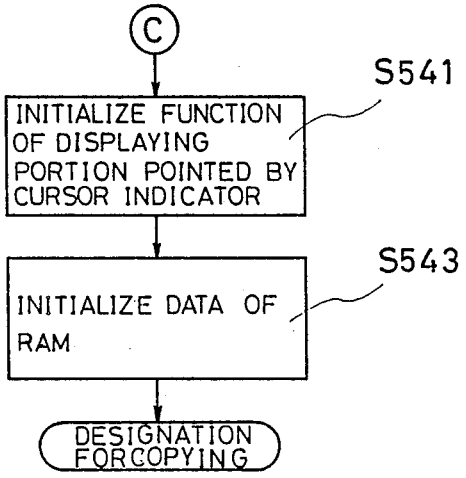

Next, in the step S507 of FIG. 30A, it is determined whether or not the clear key 283 as shown in FIG. 27 is operated. If confirmed that the clear key 352 is operated in the step S507, the process proceeds to the step S541 as shown in FIG. 30D.

In the step S541, if the cursor indicator 212*g* is lightened and a displaying on the original size displaying portion 364 is "LTR", the displaying of the original size displaying portion 214 is returned to "LD" when the clear key 352 is operated. This means that even in the case where the size of "LTR" of the paper is selected by operating the change key 356, upon an operation of the clear key 352, such a selection of the paper size is initialized and returned to the state initially set.

Next, by operating the clear key 352, the data of the RAM 276 is also initialized in the step S543. Returning to FIG. 30A, in the step S509, it is determined whether or not the reset key 116 is operated. If the reset key 116 is operated, the process proceeds to the step S545. In the step S545, the data of the RAM 276 is wholly cleared and becomes initialized state which is the same state that the initial state in turning on the electric power.

In the step S547, if any one of the cursor indicators is lightened, the cursor indicator 362*a* is changedly lightened. Then, the displayed contents of the LCD 360 are returned to the initail state shown in FIG. 27 by operating the reset key 116 even in the case where the contents shown in FIG. 28, for example are displayed in the displaying portions 364–378.

In addition, as a storage medium, magnetic storage medium such as a magnetic tape, magnetic disk and the like can be used other than the above described IC card 174 (or 290). In this case, magnetic heads must be provided on the editor 180 and the copying machine main unit 12 for writing to the magnetic storage medium and/or for reading the data therefrom.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for inputting image forming condition, comprising:

a display having an item displaying portion in which a plurality of items of image forming condition for controlling image forming process are respectively displayed for each item and a cursor displaying portion in which a plurality of cursors are formed correspondingly to the respective items of said item displaying portion, cursor selecting means for selectively displaying a desired one of said plurality of cursors included in said cursor displaying portion, operating means which is operated to change said image forming condition, and display changing means for changing content of display of the item of said item displaying portion corresponding to the cursor selectively displayed at a time when said operating means is operated, the content lastly changed being inputted as the image forming condition of that item.

2. An apparatus for inputting image forming condition in accordance with claim 1, wherein said display changing means includes condition storing means for storing in advance a plurality of conditions which can be respectively changed for each item, and selecting means for selecting said plurality of conditions of that item in response to an operation of said operating means.

3. An apparatus for inputting image forming condition in accordance with claim 2, wherein said selecting means includes sequentially selecting means for sequentially selecting said plurality of conditions for each operation of said operating means.

4. An apparatus for inputting image forming condition in accordance with claim 3, wherein said operating means includes a common key which is commonly operated for respective items.

5. An apparatus for inputting image forming condition in accordance with claim 4, wherein said operating means includes a further key which is different from said common key and is used to change a specific item, and said display changing means includes means for changing displaying with respect to said specific item when said further key is operated.

6. An apparatus for inputting image forming condition in accordance with claim 3, wherein said cursor displaying portion include a plurality of cursors arranged in a line, said cursor selecting means includes a first key for sequentially moving a given direction the cursor to be displayed in said cursor displaying portion and a second key for sequentially moved in reverse direction the cursor to be displayed in said cursor displaying portion.

7. A copying machine, comprising:

a main unit, copying means accommodated in said main unit for copying an original, a display having an item displaying portion in which a plurality of items of copying conditions for controlling said copying means are respectively displayed for each item and a cursor displaying portion in which a plurality of cursors are formed correspondingly to the respective items of said item displaying portion, cursor selecting means for selectively displaying a desired one of said plurality of cursors included in said cursor displaying portion, operating means which is operated to change said copying condition, display changing means for changing content of display of the item of said item displaying portion corresponding to the cursor selectively displayed at a time when said operating means is operated, and means for applying the copying condition lastly changed by said display changing means.

8. A copying machine in accordance with claim 7, wherein said display changing means includes condition storing means for storing in advance a plurality of conditions which can be respectively changed for each item, and selecting means for selecting said plurality of copying conditions of that item in response to an operation of said operating means.

9. A copying machine in accordance with claim 8, wherein said selecting means includes sequentially selecting means for sequentially selecting said plurality of conditions for each operation of said operating means.

10. A copying machine in accordance with claim 9, wherein said operating means includes a common key which is commonly operated for respective items.

11. A copying machine in accordance with claim 10, wherein said operating means includes a further key which is different from said common key and is used to change a specific item, and said display changing means includes means for changing displaying with respect to said specific item in response to an operation of said further key.

12. A copying machine in accordance with claim 9, wherein said cursor displaying portion include a plurality of cursors arranged in a line, said cursor selecting means includes a first key for sequentially moving a given direction the cursor to be displayed in said cursor displaying portion and a second key for sequentially moved in reverse direction the cursor to be displayed in said cursor displaying portion.

13. An apparatus for inputting copying condition into a copying machine provided separately from the apparatus, comprising:

a main unit, a display having an item displaying portion in which a plurality of items of copying condition for controlling copying process in said copying machine are respectively displayed for each item and a cursor displaying portion in which a plurality of cursors are formed correspondingly to the respective item displaying portion, cursor selecting means for selectively displaying a desired one of said plurality of cursors included in said cursor displaying portion, operating means which is operated to change said copying condition, display changing means for changing content of display of the item of said item displaying portion corresponding to the cursor selectively displayed at a time when said operating means is operated, and means for applying the copying condition lastly changed by said display changing means to said copying machine.

14. An apparatus for inputting copying condition in accordance with claim 13, wherein said display changing means includes condition storing means for storing in advance a plurality of copying conditions which can be respectively changed for each item, and selecting means for selecting said plurality of copying conditions of the item in response to an operation of said operating means.

15. An apparatus for inputting copying condition in accordance with claim 14, wherein said selecting means includes sequentially selecting means for sequentially selecting said plurality of conditions for each operation of said operating means.

16. An apparatus for inputting copying condition in accordance with claim 15, wherein said operating means includes a common key which is commonly operated for respective items.

17. An apparatus for inputting copying condition in accordance with claim 16, wherein said operating means includes a further key which is different from said common key and is used to change a specific item, and said display changing means includes means for changing displaying with respect to said specific item in response to an operation of said further key.

18. An apparatus for inputting copying condition in accordance with claim 14, wherein said cursor displaying portion include a plurality of cursors arranged in a line, said cursor selecting means includes a first key for sequentially moving a given direction the cursor to be displayed in said cursor displaying portion and a second key for sequentially moved in reverse direction the cursor to be displayed in said cursor displaying portion.

19. An apparatus for inputting copying condition in accordance with claim 17, further comprising a tablet provided on said main unit and including a combination of resistive sheets, and an input pen for depressing a position on said tablet.

20. An apparatus for inputting copying condition in accordance with claim 19, wherein said common key and said further key are both formed on said tablet and operated by said input pen.

21. An apparatus for inputting copying condition in accordance with claim 20, further comprising means for generating positional data corresponding to the depressed position when the tablet is depressed.

22. An apparatus for inputting copying condition in accordance with claim 21, further comprising displaying means for displaying whether or not point positions of the number necessary for editing have been set by said input pen.

23. An apparatus for inputting copying condition in accordance with claim 21, further comprising an editing key portion for setting an editing function to be executed based on said positional data.

24. An apparatus for inputting copying condition in accordance with claim 23, wherein said editing key portion includes at least one of "trimming" key, "masking" key and "moving" key.

* * * * *